US008919635B1

(12) United States Patent
Biagioni et al.

(10) Patent No.: US 8,919,635 B1
(45) Date of Patent: Dec. 30, 2014

(54) BLANK FOR COLLAPSIBLE FOLDED CONTAINER

(71) Applicants: John J. Biagioni, Arlington, MA (US); Deborah J. Biagioni, Arlington, MA (US)

(72) Inventors: John J. Biagioni, Arlington, MA (US); Deborah J. Biagioni, Arlington, MA (US)

( * ) Notice: Subject to any disclaimer, the term of this patent is extended or adjusted under 35 U.S.C. 154(b) by 0 days.

(21) Appl. No.: 14/166,371

(22) Filed: Jan. 28, 2014

(51) Int. Cl.
*B65D 5/36* (2006.01)
*B65D 1/22* (2006.01)
*B31B 3/26* (2006.01)

(52) U.S. Cl.
CPC . *B65D 1/225* (2013.01); *B31B 3/26* (2013.01); *Y10S 229/902* (2013.01)
USPC ..... 229/117.01; 229/902; 206/172

(58) Field of Classification Search
USPC ..... 229/108.1, 117.01, 902, 903, 117.05; 206/170, 172, 175, 180, 181, 189
See application file for complete search history.

(56) References Cited

U.S. PATENT DOCUMENTS 2,603,409 A * 7/1952 Crary ..... 383/14
5,014,853 A 5/1991 Crockett
5,110,038 A 5/1992 Pantisano et al.
5,209,392 A 5/1993 Anatro
5,273,206 A 12/1993 Vassiliou
5,305,949 A 4/1994 Linden
5,476,216 A 12/1995 Robertella et al.
D390,110 S 2/1998 Mario
6,375,066 B1 4/2002 Ritter
6,386,440 B1 5/2002 Tulkoff
6,915,948 B2 7/2005 George
7,051,919 B1 5/2006 Walsh
2002/0079357 A1 * 6/2002 Tulkoff ..... 229/120.32
2005/0087591 A1 4/2005 McBride et al.
2006/0226206 A1 10/2006 Reap
2008/0006679 A1 1/2008 Volz et al.
2010/0133329 A1 * 6/2010 Dickie ..... 229/117.01

* cited by examiner

*Primary Examiner* — Christopher Demeree
(74) *Attorney, Agent, or Firm* — McCarter & English, LLP; Anita M. Bowles; Vadim Cherkasov

(57) ABSTRACT

Exemplary embodiments are directed to blanks for a collapsible, folded container for food that include a lower panel and an upper panel. The upper panel can include a hinge portion hingedly connecting the lower panel to the upper panel. The blanks include a lengthwise fold line extending along a length of the blanks, a first lateral fold line extending across the lower panel, and a second lateral fold line extending across the upper panel. The blanks can be adapted to be folded into a container configuration, subsequently unfolded into an unfolded configuration, and then re-folded into a collapsed configuration.

21 Claims, 12 Drawing Sheets

BLANK FOR COLLAPSIBLE FOLDED CONTAINER

TECHNICAL FIELD

The present disclosure relates to a blank for a collapsible, folded container and, in particular, to a blank that is adapted to be folded into a container configuration, subsequently unfolded into an unfolded configuration, and then compactly re-folded into a collapsed configuration for disposal.

BACKGROUND

In the food industry, containers are generally used to transport and/or store food. For example, boxes for transporting pizza are typically formed from a cardboard blank folded into a container configuration. In the container configuration, the pizza box defines a width, length and height dimensioned to accommodate a pizza of a particular size. Once the pizza has been transported from the point of origination to the consumer and the pizza has been consumed or removed from the pizza box, the pizza box can be discarded or recycled. However, the size, shape, and rigidity of the traditional pizza box can make it difficult to compactly dispose of the pizza box. Consumers typically attempt to crush the pizza box to a smaller size or leave the pizza box near a trash receptacle for future disposal.

Thus, a need exists for a blank for a collapsible, folded container which is adapted to be folded into a container configuration for transport of, e.g., pizza, adapted to be unfolded into an unfolded configuration, and then compactly re-folded into a stable collapsed configuration for disposal. These and other needs are addressed by the collapsible, folded containers of the present disclosure.

SUMMARY

In accordance with some embodiments of the present disclosure, an exemplary blank for a collapsible, folded container for food is provided that generally includes a lower panel and an upper panel. The lower panel includes a base portion that forms a food supporting surface when the blank is folded into a container configuration. The upper panel includes a hinge portion hingedly connecting the upper panel with the lower panel at a first hinge fold line. The upper panel further includes a top portion hingedly connecting with the hinge portion at a second hinge fold line.

The exemplary blank includes a lengthwise fold line extending along a length of the blank at least through the base portion of the lower panel, the hinge portion of the upper panel, and the top portion of the upper panel. A first lateral fold line extends across the lower panel. In some embodiments, the first lateral fold line is oriented perpendicular to the lengthwise fold line. The first lateral fold line divides the base portion into a first part and a second part. In some embodiments, an area of the second part is substantially larger than an area of the first part. A second lateral fold line extends across the upper panel through the top portion. In some embodiments, the second lateral fold line is be oriented perpendicular to the lengthwise fold line.

As noted above, the exemplary blank can be folded into a container configuration. The exemplary blank can subsequently be unfolded into an unfolded configuration. The additional fold lines disclosed here enable the blank to be re-folded using the lengthwise fold line, the first lateral fold line, the first hinge fold line, and the second lateral fold line into a collapsed configuration.

The blank has a container width and a container length while in the container configuration. The blank can have a collapsed width smaller than the container width and a collapsed length smaller than the container length when in a collapsed configuration. In some embodiments, the collapsed length can be in a range of approximately 40% to approximately 60% of the container length. In some embodiments, the collapsed width can be in a range of approximately 40% to approximately 60% of the container width. In some embodiments, the blank can include instructions for unfolding the blank from a container configuration and re-folding the blank into a collapsed configuration. In some embodiments, the instructions can be printed on or secured to the blank.

In some embodiments, the lengthwise fold line divides the base portion into two parts having substantially equal areas. The lengthwise fold line includes an upper panel portion and a lower panel portion. In some embodiments, the second lateral fold line divides the upper panel portion of the lengthwise fold line into two segments having about equal lengths. The lower panel includes a front end portion hingedly connected to the base portion. In some embodiments, the front end portion includes at least one cut-out adapted to assist in unfolding the blank from the container configuration to the unfolded configuration.

The lower panel can include a front end portion with a first corner and a second corner. The lower panel further includes a first lateral side portion and a second lateral side portion. In some embodiments, a first flap is disposed at the first corner and hingedly connected to the first lateral side portion. In some embodiments, a second flap is disposed at the second corner and hingedly connected to the second lateral side portion. In some embodiments, the first flap and the second flap are adapted to interlock with each other, thereby forming an interlocking mechanism that secures a configuration of the blank when it is in the collapsed configuration.

In some embodiments, the first flap includes a slot. The slot can be adapted to at least partially receive the second flap therethrough. In some embodiments, the second flap includes at least one notch. The at least one notch can be adapted to interlock with the slot to maintain the blank in the collapsed configuration.

In some embodiments, the first flap includes a first notch and the second flap includes a second notch. The first notch can be adapted to interlock with the second notch to maintain the blank in the collapsed configuration.

In some embodiments, at least one of the first flap and the second flap includes adhesive thereon. The adhesive can be adapted to interlock the first flap and the second flap to maintain the blank in the collapsed configuration.

In some embodiments, the first flap is hingedly connected to the first lateral side portion at a first diagonal fold line. In some embodiments, the second flap is hingedly connected to the second lateral side portion at a second diagonal fold line. The first diagonal fold line and the second diagonal fold line can be oriented diagonally to the lengthwise fold line.

In another embodiment of the present disclosure, an exemplary blank for a collapsible container for food is provided that generally includes a lower panel and an upper panel. The lower panel includes a base portion that forms a food supporting surface when the blank is folded into a container configuration. The lower panel includes a front end portion including interlocking elements. The lower panel further includes a first lateral fold line extending through the base portion. The upper panel includes a hinge portion hingedly connected with the lower panel at a first hinge fold line. The second part of the lower panel surface can be proximal to the hinge portion. The upper panel includes a top portion hingedly connected with the hinge portion. The upper panel further includes a second lateral fold line extending through the top portion. The exemplary blank further includes a lengthwise fold line extending through the lower panel and the upper panel.

In some embodiments, the exemplary blank maintains a stable collapsed configuration when collapsed by mountain-type folding at the first lateral fold line, mountain-type folding at the second lateral fold line, and valley-type folding at the first hinge fold line resulting in an accordion-type configuration that can be subsequently folded along the lengthwise fold line and secured using interlocking elements (e.g., the locking mechanism).

In some embodiments, the interlocking elements include a first flap and a second flap. The first flap can be disposed at a first corner of the front end portion and hingedly connected to a first lateral portion of the lower panel at a first diagonal fold line. The second flap can be disposed at a second corner of the front end portion and hingedly connected to a second lateral portion of the lower panel at a second diagonal fold line. The first and second diagonal fold lines can be oriented diagonally to the lengthwise fold line.

In some embodiments, the first flap includes a slot and the second flap includes at least one notch. The slot is adapted to at least partially receive the second flap therethrough. In some embodiments, the interlocking elements are adapted to releasably interlock relative to each other.

Some embodiments of the present disclosure include a method of forming a blank for a collapsible, folded container for food. The method includes providing a blank having a lower panel and an upper panel. The lower panel includes a base portion that forms a food supporting surface when the blank is folded into a container configuration. The upper panel includes a hinge portion hingedly connecting with the lower panel at a first hinge fold line. The upper panel includes a top portion hingedly connecting with the hinge portion at a second hinge fold line.

In some embodiments, the method includes forming a lengthwise fold line extending alone a length of the blank at least through the base portion of the lower panel, the hinge portion of the upper panel and the top portion of the upper panel. The method includes forming a first lateral fold line extending across the lower panel. In some embodiments, the first lateral fold line is oriented perpendicular to the lengthwise fold line. The first lateral fold line divides the base portion into a first part and a second part. In some embodiments, an area of the second part is substantially larger than an area of the first part. The method further includes forming a second lateral fold line extending across the upper panel through the top portion. In some embodiments, the second lateral fold line is oriented perpendicular to the lengthwise fold line.

In some embodiments, the method includes forming a latching mechanism including a first flap at a first corner of a front end portion of the lower panel and forming a second flap at a second corner of the front end portion of the lower panel. The first flap and the second flap can be adapted to interlock with each other when the blank is in a collapsed configuration. In some embodiments, the method includes forming a slot in the first flap and forming at least one notch in the second flap. The slot can be adapted to at least partially receive the second flap therethrough.

In some embodiments, the method further includes forming a first diagonal fold line along a first lateral side portion. The first diagonal fold line can hingedly connect the first flap to the first lateral side portion and can be oriented diagonally to the lengthwise fold line. In some embodiments, the method further includes forming a second diagonal fold line along a second lateral side portion. The second diagonal fold line can hingedly connect the second flap to the second lateral side portion and can be oriented diagonally to the lengthwise fold line.

It should be understood that the fold lines discussed herein can be formed in any manner known in the industry, such as, for example, partial perforation of the blank, perforation through an entire thickness of the blank, creases formed in the blank, folds formed in the blank, partial cuts through the blank, imperforated impressed folds in the blank, a dot-dot-dot perforation pattern, a line-dot-line-dot perforation pattern, a line-line-line perforation pattern, a dot-dot-dot perforation pattern, and combinations thereof. For example, the fold lines can be imperforated to prevent or reduce passage of oil through the blank. It should be understood that the fold lines discussed herein can be formed such that the blank retains a strong structural form in the container configuration, while permitting collapsing of the blank when pressure is applied along the appropriate fold lines when re-folding the blank into the collapsed configuration. However, it should be understood that the examples of fold line formation provided herein are merely illustrative and alternative methods of forming fold lines in the exemplary blank can be employed. It should further be understood that the fold lines discussed herein can be formed on the inside (or food-supporting) surface of the blank and/or the outside surface of the blank.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed blank for a collapsible folded container, reference is made to the accompanying figures, wherein.

DESCRIPTION OF EXEMPLARY EMBODIMENTS

The exemplary blanks discussed herein include a plurality of fold lines and cuts such that the blanks can be folded into a container configuration for transporting or storing food, subsequently unfolded into an unfolded configuration, and then re-folded into a stable, collapsed configuration for disposal. Although the fold lines and cuts will be discussed in greater detail below, it should be understood that in FIGS. 1-14, the solid lines indicate cuts in the blanks, the dotted lines indicate fold lines formed in traditional blanks, and the dashed lines indicate fold lines advantageously added to modify the traditional blanks to permit the blanks to be compactly re-folded into the collapsed configuration for disposal. It should further be understood that the exemplary fold lines discussed herein can be added to a variety of container styles or configurations to permit the containers to be compactly re-folded into the collapsed configuration.

Figure 1:
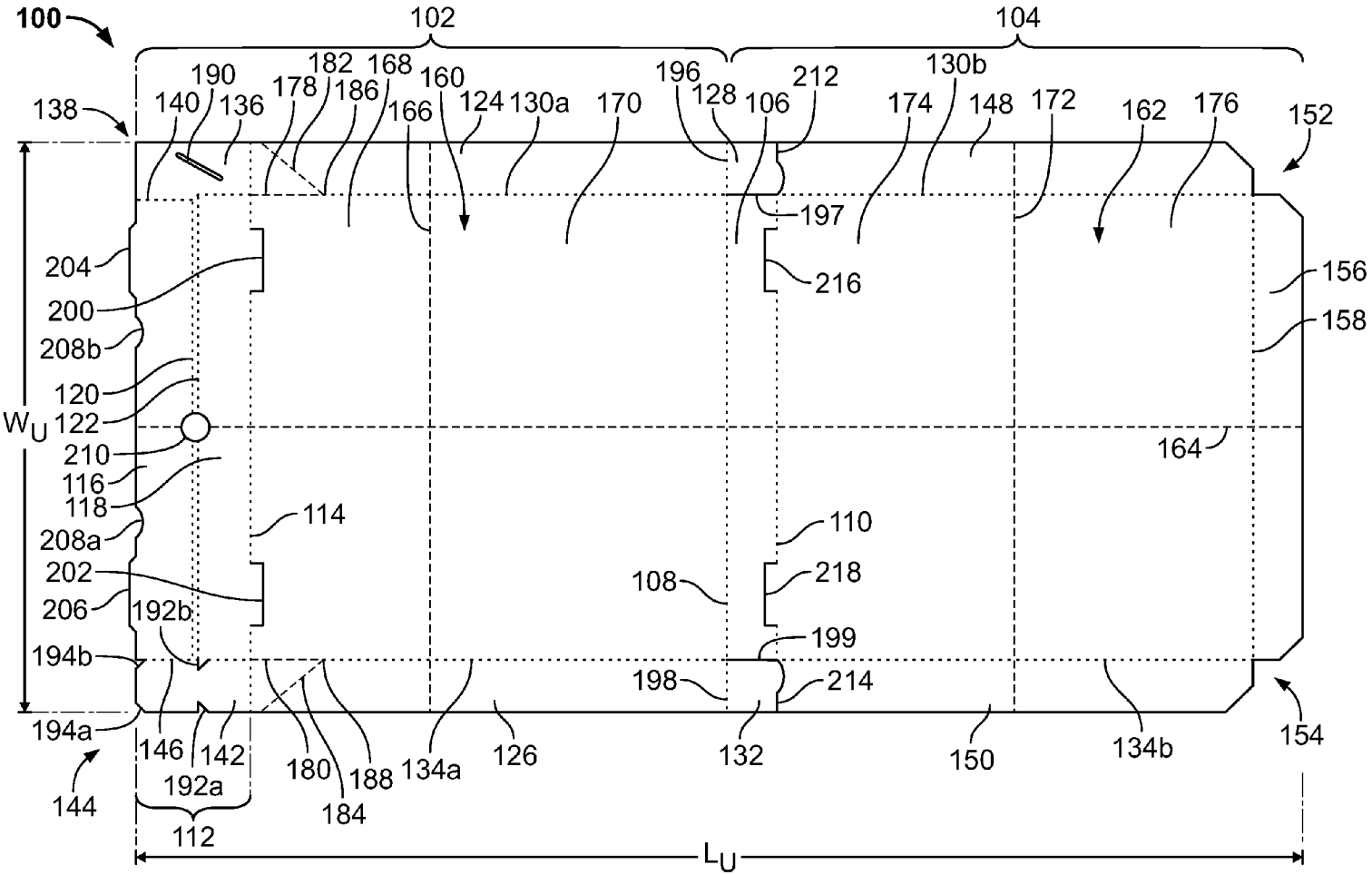
FIG. 1 is a top view of a first embodiment of a blank in an unfolded configuration according to the present disclosure.

Turning to FIG. 1, a top view of an exemplary blank 100 for a collapsible, folded container for food is provided. The blank 100 can be fabricated from, e.g., cardboard, or any other material known in the industry suitable for transporting food. It should be understood that the material of the blank 100 can be selected such that in a container configuration, the material provides sufficient support for the food being transported, while allowing the blank 100 to be conveniently collapsed into the collapsed configuration. Thus, the blank 100 can be substantially flat in the unfolded configuration and can define a thickness suitable for providing the requisite support for the food product when in the container configuration.

The blank 100 is adapted to be folded into a container configuration, unfolded into an unfolded configuration, and then folded into a stable, collapsed configuration. Before addressing additional fold lines and cutouts that facilitate unfolding the blank and then folding it into the collapsed configuration, the fold lines that facilitate initial folding of the blank 100 into the container configuration are described.

The blank 100 can define an unfolded length $L_U$ and a width $W_U$. As discussed herein, it should be understood that references to a lengthwise direction are to a direction substantially along the length $L_U$ of the unfolded blank and references to a lateral direction are to a direction substantially along the width $W_U$ of the unfolded blank. For example, reference to a lengthwise fold line relates to a fold line that, at least partially, extends along the length $L_U$ of the blank 100. Similarly, reference to a lateral fold line relate to a fold line that, at least partially, extends along the width $W_U$ of the blank 100.

The blank 100 can include a lower panel 102 and an upper panel 104 hingedly connected relative to each other. In particular, the upper panel 104 can include a hinge portion 106 that extends laterally across the blank 100 and is positioned between the lower panel 102 and the upper panel 104. For example, the hinge portion 106 can hingedly connect to the lower panel 102 at a first lateral hinge fold line 108 and can hingedly connect to the upper panel 104 at a second lateral hinge fold line 110, thereby hingedly connecting the lower panel 102 to the upper panel 104.

The lower panel 102 can include a front end portion 112 hingedly connected to the lower panel 102 at a front lateral hinge fold line 114. The front end portion 112 can include a first front side portion 116 hingedly connected to a second front side portion 118. As depicted in FIG. 1, the first and second front side portions 116, 118 can be hingedly connected at double front hinge fold lines 120, 122. The double front hinge fold lines 120, 122 can be positioned substantially near each other to permit the first front side portion 116 to fold along the two double front hinge fold lines 120, 122 and be positioned adjacent to the second front side portion 118. In some embodiments, rather than two double hinge fold lines 120, 122, the first and second front side portions 116, 118 can be hingedly connected by a single lateral hinge fold line, e.g., only front hinge fold line 120.

The lower panel 102 can include a first lateral side portion 124 and a second lateral side portion 126. The first lateral side portion 124 can extend between a first middle flap 128 of the hinge portion 106 and the front lateral hinge fold line 114 of the front end portion 112, and can be hingedly connected to a base portion 160 of the lower panel at a first part of a first side hinge fold line 130*a*. The second lateral side portion 126 can extend between a second middle flap 132 of the hinge portion 106 and the front lateral hinge fold line 114 of the front end portion 112, and can be hingedly connected to the base portion 160 of the lower panel at a first part of a second side hinge fold line 134*a*.

Figure 2:
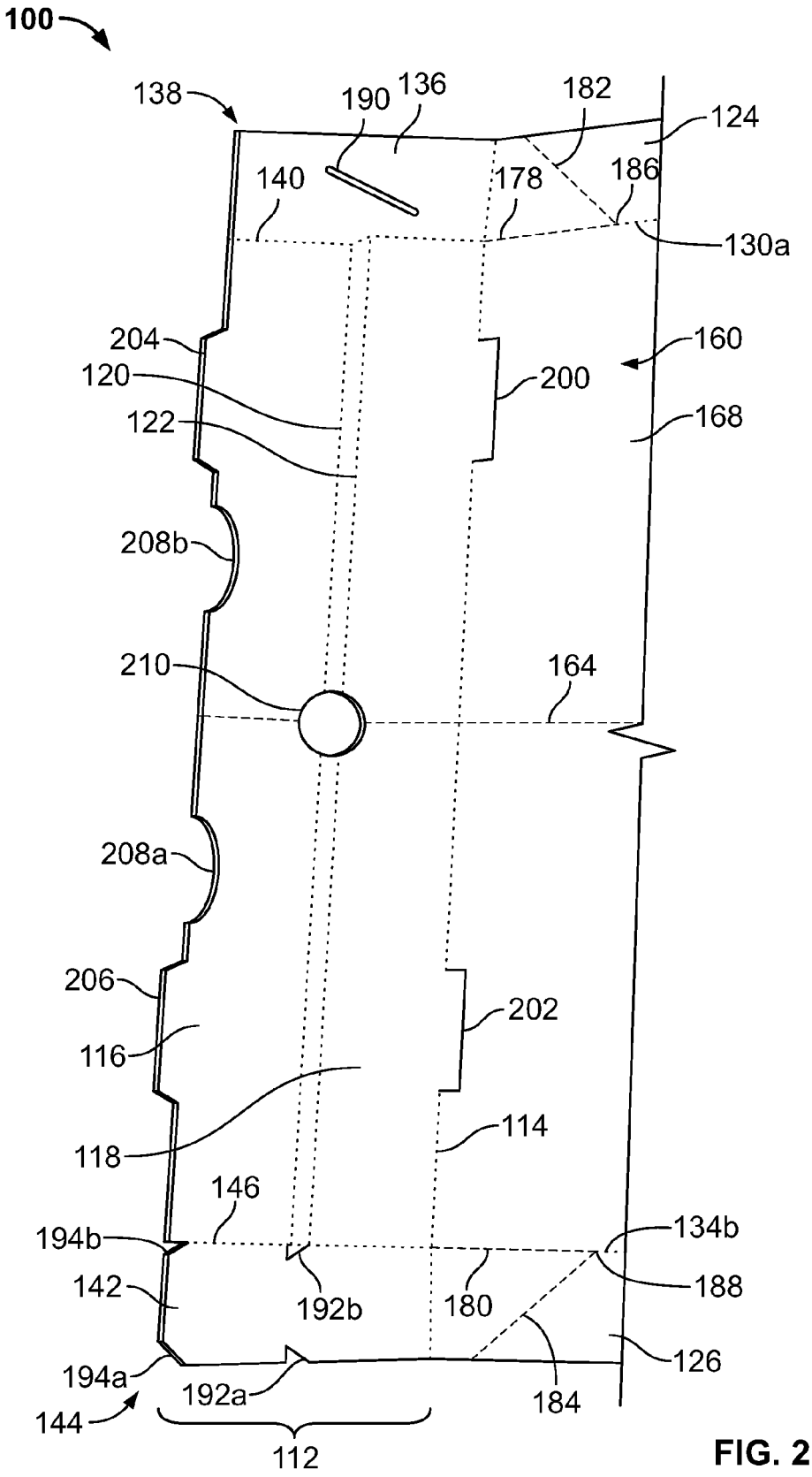
FIG. 2 is a detail of the top view of the blank of FIG. 1 in an unfolded configuration depicting a first embodiment of an interlocking mechanism.

As shown in FIG. 1 and the detailed view of FIG. 2, the first lateral side portion 124 can include a first flap 136 disposed at a first corner 138 of the front end portion 112. In particular, for purposes of folding the blank 100 into the container configuration, the first flap 136 can be hingedly connected to the first lateral side portion 124 at the front lateral hinge fold line 114 and can be connected to the front end portion 112 along a first front fold line 140 which can be substantially in-line and parallel to the first part of the first side hinge fold line 130*a*. The first front fold line 140 can be formed in the blank 100 such that the first flap 136 can be torn or separated from the front end portion 112 along the first front fold line 140 up to the front lateral hinge fold line 114. In some embodiments, the first front fold line 140 can be formed as a perforated line or can include only a few points of attachment to allow temporary attachment of the first flap 136 to the front end portion 112 and further allow separation of the first flap 136 from the front end portion 112 by tearing or separating along the first front fold line 140. The first flap 136 can thereby be movably connected to the first lateral side portion 124.

Similarly, the second lateral side portion 126 can include a second flap 142 disposed at a second corner 144 of the front end portion 112. In particular, for purposes of folding the blank 100 into the container configuration, the second flap 142 can be hingedly connected to the second lateral side portion 126 at the front lateral hinge fold line 114 and can be connected to the front end portion 112 along a second front fold line 146 which can be substantially in-line and parallel to the first part of the second side hinge fold line 134*a*. The second front fold line 146 can be formed in the blank 100 such that the second flap 142 can be torn or separated from the front end portion 112 along the second front fold line 146 up to the front lateral hinge fold line 114. In some embodiments, the second front fold line 146 can be formed as a perforated line or can include only a few points of attachment to allow temporary attachment of the second flap 142 to the front end portion 112 and further allow separation of the second flap 142 from the front end portion 112 by tearing or separating along the second front fold line 146. The second flap 142 can thereby be movably connected to the second lateral side portion 126.

The upper panel 104 can include a third lateral side portion 148 and a fourth lateral side portion 150. The third lateral side portion 148 can extend in-line with and parallel to the first lateral side portion 124 and can extend between the first middle flap 128 of the hinge portion 106 and the third corner 152 of the blank 100. The third lateral side portion 148 can be hingedly connected to a top portion 162 of the upper panel at the second part of the first side hinge fold line 130*b*. As shown in FIG. 1, the first and second parts of the first side hinge fold line 130*a*, 130*b* can be substantially in-line relative to each other and can be separated by a first middle flap cut 197, which will be discussed in greater detail below. The fourth lateral side portion 150 can extend in-line with and parallel to the second lateral side portion 126 and can extend between the second middle flap 132 and the fourth corner 154 of the blank 100. The fourth lateral side portion 150 can be hingedly connected to the top portion 162 of the upper panel at the second part of the second side hinge fold line 134*b*. As shown in FIG. 1, the first and second parts of the second side hinge fold line 134*a*, 134*b* can be substantially in-line relative to each other and can be separated by a second middle flap cut 199, which will be discussed in greater detail below. The upper panel 104 can further include a back end portion 156 hingedly connected to the top portion 162 of the upper panel at a third lateral hinge fold line 158. In particular, the third lateral hinge fold line 158 can extend between and perpendicular to the second part of the first side hinge fold line 130*b* and the second part of the second side hinge fold line 134*b*.

For reference, the top surface of the blank 100 shown in FIG. 1 is referred to as the inner surface of the blank 100 and the bottom surface of the blank (face down in FIG. 1) is referred to as the outer surface of the blank 100 herein. However, one of ordinary skill in the art would appreciate that this convention could equally be the opposite and all references to the outer surface and the inner surface could be reversed. The area of the lower panel 102 bounded by the intersecting portions of the first part of the first and second side hinge fold lines 130*a*, 134*a* and the lateral hinge fold lines 108, 114 can define the base portion 160, e.g., the food-supporting surface, when the blank 100 is folded into the container configuration. Similarly, the area of the upper panel 104 bounded by the second parts of the first and second side hinge fold lines 130*b*, 134*b*, the second lateral hinge fold line 110, and the third lateral hinge fold line 158 defines the top portion 162, e.g., the lid portion, which would be positioned above the food and opposite the base portion 160 when the blank 100 is folded into the container configuration and closed.

In addition to the fold lines discussed above that enable the blank 100 to be folded into a container configuration, the blank 100 includes additional fold lines and cutouts that facilitate unfolding the blank 100 from a container configuration to an unfolded configuration, and then refolding the blank 100 into a stable collapsed configuration, in accordance with some embodiments. The blank 100 includes a lengthwise fold line 164 extending across the entire length $L_U$ of the blank 100. In particular, the lengthwise fold line 164 can extend across the lower panel 102, the hinge portion 106 and the upper panel 104. The lengthwise fold line 164 can be positioned at a central position of the width $W_U$ of the blank 100 such that the lengthwise fold line 164 divides the front end portion 112, the base portion 160, the hinge portion 106, the top portion 162 and the back end portion 156 into substantially equal areas, e.g., two substantially equal halves.

With respect to the lower panel 102, the blank 100 can include a first lateral fold line 166 that extends laterally the entire width $W_U$ of the blank 100 and is substantially perpendicular to the lengthwise fold line 164. In particular, the first lateral fold line 166 divides the lower panel 102 into two substantially equal areas, e.g., two substantially equal halves. However, the first lateral fold line 166 divides the base portion 160 of the lower panel into two unequal areas, e.g., a first part 168 and a second part 170, where the area of the second part 170 is substantially larger than the area of the first part 168. Specifically, the area of the first part 168 can be defined by the intersecting portions of the first part of the first and second side hinge fold lines 130*a*, 134*a*, the front lateral hinge fold line 114 and the first lateral fold line 166. The area of the second part 170 can be defined by the intersecting portions of the first part of the first and second side hinge fold lines 130*a*, 134*a*, the first lateral hinge fold line 108 and the first lateral fold line 166. As shown in FIG. 1, the first lateral fold line 166 can be offset from a center of the base portion 160 such that the area of the second part 170 is dimensioned substantially larger than the area of the first part 168. Thus, the distance from the first lateral hinge fold line 108 to the first lateral fold line 166 can be substantially greater than the distance from the first lateral fold line 166 to the front lateral hinge fold line 114.

With respect to the upper panel 104, the blank 100 can include a second lateral fold line 172 which extends laterally the entire width $W_U$ of the blank 100 and is substantially perpendicular to the lengthwise fold line 164. In particular, the second lateral fold line 172 can divide the top portion 162 of the upper panel 104 into two substantially equal areas, e.g., two substantially equal halves. The second lateral fold line 172 divides the top portion 162 into two substantially equal areas, e.g., a first part 174 and a second part 176, where the area of the first part 174 is dimensioned substantially equal to the area of the second part 176. Specifically, the area of the first part 174 can be defined by the intersecting portions of the second parts of the first and second side hinge fold lines 130*b*, 134*b*, the second lateral hinge fold line 110 and the second lateral fold line 172. The area of the second part 176 can be defined by the intersecting portions of the second parts of the first and second hinge fold lines 130*b*, 134*b*, the second lateral fold line 172 and the third lateral hinge fold line 158. As shown in FIG. 1, the second lateral fold line 172 is positioned at approximately a center of the top portion 162 such that the area of the first part 174 is dimensioned substantially equal to the area of the second part 176. Thus, the distance from the second lateral hinge fold line 110 to the second lateral fold line 172 is substantially equal to the distance from the second lateral fold line 172 to the third lateral hinge fold line 158.

In some embodiments, the first part of the first and second side hinge fold lines 130*a*, 134*a* and the second part of the first and second side hinge fold lines 130*b*, 134*b* can be substantially aligned relative to each other and can extend the entire length $L_U$ of the blank 100, except for the first and second middle flap cuts 197, 199, respectively, separating the first and second parts of the first and second side hinge fold lines 130*a*, 130*b*, 134*a*, 134*b* at the hinge portion 106. In the embodiment shown in FIG. 1, first and second perforated lengthwise fold lines 178, 180 can be formed in the blank 100 as an extension of the first part of the first and second side hinge fold lines 130*a*, 134*a*. For example, with respect to the first part of the first side hinge fold line 130*a*, the first perforated fold line 178 can be formed along the first part of the first side hinge fold line 130*a* starting from the front lateral hinge fold line 114 and extending a partial distance, e.g., halfway, and the like, in the direction of the first lateral fold line 166. With respect to the first part of the second side hinge fold line 134*a*, the second perforated lengthwise fold line 180 can be formed along the first part of the second side hinge fold line 134*a* starting from the front lateral hinge fold line 114 and extending a partial distance, e.g., halfway, and the like, in the direction of the first lateral fold line 166. In some embodiments, the first and second perforated lengthwise fold lines 178, 180 can extend less than or greater than halfway between the front lateral hinge fold line 114 and the first lateral fold line 166. In some embodiments, the first and second perforated lengthwise fold lines 178, 180 can be formed in the blank 100 with a more frequent pattern of perforations, e.g., approximately every 1/16 inches to 1/8 inches, to allow less resistance when tearing the blank 100 along the first and second perforated lengthwise fold lines 178, 180.

In the embodiment shown in FIG. 1, first and second diagonal fold lines 182, 184 can further be formed in the first and second lateral side portions 124, 126 of the blank 100. The first and second diagonal fold lines 182, 184 can be substantially diagonal relative to the lengthwise fold line 164, the first and second lateral fold lines 166, 172, and the lengthwise and lateral fold lines discussed herein. For example, the first diagonal fold line 182 can initiate from an endpoint 186 of the first perforated lengthwise fold line 178 positioned between the front lateral hinge fold line 114 and the first lateral fold line 166. The first diagonal fold line 182 can extend in the direction of the front lateral hinge fold line 114 up to an outer edge of the first lateral side portion 124 offset from the front lateral hinge fold line 114. During re-folding of the blank 100 into the collapsed configuration, positioning the first diagonal fold line 182 offset from the front lateral hinge fold line 114 may prevent tearing of the blank 100 along the front lateral hinge fold line 114. In some embodiments, the first diagonal fold line extends in the direction of the front lateral hinge fold line 114 up to an outer edge of the first lateral side portion and connects with the front lateral hinge fold line.

Similarly, the second diagonal fold line 184 can initiate from an endpoint 188 of the second perforated lengthwise fold line 180 positioned between the front lateral hinge fold line 114 and the first lateral fold line 166. The second diagonal fold line 184 can extend in the direction of the front lateral hinge fold line 114 up to an outer edge of the second lateral side portion 126 offset from the front lateral hinge fold line 114. During re-folding of the blank 100 into the collapsed configuration, positioning the second diagonal fold line 184 offset from the front lateral hinge fold line 114 may prevent tearing of the blank 100 along the front lateral hinge fold line 114. In some embodiments, the second diagonal fold line extends in the direction of the front lateral hinge fold line up to an outer edge of the second lateral side portion and connects with the front lateral hinge fold line.

In some embodiments, the fold lines that connect with first perforated lengthwise fold line 178 and the second perforated lengthwise fold line 180 may be oriented at an angle other than 45 degrees (e.g., 30 degrees, 60 degrees) with respect to any of the lengthwise fold lines, and the first and second lateral fold lines.

Still with reference to FIG. 1, the blank 100 is shown with a first embodiment of an interlocking mechanism for maintaining the blank 100 in the collapsed configuration. As will be described in greater detail below, the interlocking mechanism functions by physically interlocking the first and second flaps 136, 142. For example, the first flap 136 includes a slot 190 formed therethrough to permit engagement with the second flap 142. In some embodiments, the slot 190 is a rounded rectangular slot cut out of the blank 100. In some embodiments, the slot 190 is oriented diagonally relative to the lateral and lengthwise fold lines of the blank 100.

In some embodiments, the second flap 142 includes perforations or cutouts for one or more notches that aid in securing the second flap in the slot. For example, second flap 142 includes two punch-out cuts offset from the second corner 144 of the front end portion 112, e.g., one punch-out cut forming a first notch 192*a* at an outer edge of the second flap 142 and one punch-out cut at the first part of the second side hinge fold line 134*a* for forming a second notch 192*b* in the second flap 142. In some embodiments, the second flap 142 may include only one notch. In some embodiments, the second flap 142 may include more than two notches. Optionally, the second flap 142 can include two additional punch-out cuts at the second corner 144 of the front end portion 112 to create first and second chamfered or rounded edges 194*a*, 194*b* in the second flap 142. The slot 190 of the first flap 136 is configured and dimensioned to receive the second flap 142 therethrough up to the first and second notches 192*a*, 192*b*. As will be described in greater detail below, in the collapsed configuration, the second flap 142 can be passed through the slot 190 such that the first and second notches 192*a*, 192*b* engage the slot 190 and prevent the second flap 142 from disengaging from the first flap 136, thereby functioning as a lock or clip for the "belt loop" interlocking mechanism. The interlocking engagement between the first and second flaps 136, 142 maintain the blank 100 in the collapsed configuration for disposal.

It should be understood that the fold lines discussed herein can be formed in any manner known in the industry, such as, for example, partial perforation of the blank 100, perforation through an entire thickness of the blank 100, creases formed in the blank 100, folds formed in the blank 100, partial cuts through the blank 100, imperforated impressed folds in the blank 100, a dot-dot-dot perforation pattern, a line-dot-line-dot perforation pattern, a line-line-line perforation pattern, and combinations thereof. For example, the fold lines can be imperforated to prevent or reduce passage of oil through the blank 100. It should be understood that the fold lines discussed herein can be formed such that the blank 100 retains a strong structural form in the container configuration, while permitting collapsing of the blank 100 when pressure is applied along the appropriate fold lines when re-folding the blank 100 into the collapsed configuration. However, it should be understood that the examples of fold line formation provided herein are merely illustrative and alternative methods of forming fold lines in the exemplary blank 100 can be utilized. It should further be understood that the fold lines discussed herein can be formed on the inside (or food-supporting) surface of the blank 100 and/or the outside surface of the blank 100.

In folding the blank 100 of FIG. 1 into the container configuration, the first flap 136 can be separated from the front end portion 112 along the first front fold line 140. For example, the blank 100 can be torn along the first front fold line 140 from the outer edge of the front end portion 112 to the front lateral hinge fold line 114 such that the first flap 136 can remain hingedly connected to the first lateral side portion 124 at the front lateral hinge fold line 114. Similarly, the second flap 142 can be separated from the front end portion 112 along the second front fold line 146. For example, the blank 100 can be torn along the second front fold line 146 from the outer edge of the front end portion 112 to the front lateral hinge fold line 114 such that the second flap 142 can remain hingedly connected to the second lateral side portion 126 at the front lateral hinge fold line 114. In some embodiments, rather than a fold line, the first front fold line and second front fold line can be formed as lengthwise cuts through the blank.

Next, the first middle flap 128 can be separated from the third lateral side portion 148 at a third lateral cut 212 and can be separated from the hinge portion 106 at a first middle flap cut 197. The first middle flap 128 can thereby be separated from the third lateral side portion 148 and the hinge portion 106, while remaining hingedly attached to the first lateral side portion 124 at the third lateral fold line 196. In some embodiments, the third lateral fold line 196 can extend from the outer edge of the first lateral side portion 124 to the first part of the first side hinge fold line 130*a*, and can be substantially linear. In some embodiments, the third lateral fold line 196 can be in-line with and parallel to the first lateral hinge fold line 108. In some embodiments, the third lateral fold line 196 can be formed as an extension of the first lateral hinge fold line 108. The third lateral cut 212 can be aligned with the second lateral hinge fold line 110 and can extend from the second part of the first side hinge fold line 130*b* to the outer edge of the blank 100. Although illustrated as a combination of a linear cut and a half-moon shaped cut, in some embodiments, the third lateral cut 212 can be a linear cut.

The first lateral side portion 124 can be folded inwardly along the first part of the first side hinge fold line 130*a* until the first lateral side portion 124, the first flap 136 and the first middle flap 128 are positioned at approximately 90 degrees relative to the base portion 160. The first middle flap 128 can be folded inwardly along the third lateral fold line 196 in the direction of the hinge portion 106 such that the first middle flap 128 is positioned at approximately 90 degrees relative to the hinge portion 106 and is aligned with the first lateral hinge fold line 108.

The second middle flap 132 can be similarly separated from the fourth lateral side portion 150 at a fourth lateral cut 214 and can be separated from the hinge portion 106 at a second middle flap cut 199. The second middle flap 132 can thereby be separated from the fourth lateral side portion 150 and the hinge portion 106, while remaining hingedly attached to the second lateral side portion 126 at the fourth lateral fold line 198. In some embodiments, the fourth lateral fold line 198 can extend from the outer edge of the second lateral side portion 126 to the first part of the second side hinge fold line 134*a*. In some embodiments, the fourth lateral fold line 198 can be in-line with and parallel to the first lateral hinge fold line 108. In some embodiments, the fourth lateral fold line 198 can be formed as an extension of the first lateral hinge fold line 108. The fourth lateral cut 214 can be aligned with the second lateral hinge fold line 110 and can extend from the second part of the second part of the second side hinge fold line 134*b* to the outer edge of the blank 100. Although illustrated as a combination of a linear cut and a half-moon shaped cut, in some embodiments, the fourth lateral cut 214 can be a linear cut.

The second lateral side portion 126 can be folded inwardly along the first part of the second side hinge fold line 134*b* until the second lateral side portion 126, the second flap 142 and the second middle flap 132 are positioned at approximately 90 degrees relative to the base portion 160. The second middle flap 132 can be folded inwardly along the fourth lateral fold line 198 in the direction of the hinge portion 106 such that the second middle flap 132 is positioned at approximately 90 degrees relative to the hinge portion 106 and is aligned with the first lateral hinge fold line 108.

The first and second flaps 136, 142 can be rotated inwardly approximately 90 degrees along the front lateral hinge fold line 114 to align with the front lateral hinge fold line 114 and face each other. The first and second front side portions 116, 118 of the front end portion 112 can be folded inwardly approximately 90 degrees along the front lateral hinge fold line 114 to be positioned adjacent to the first and second flaps 136, 142. The first front side portion 116 can be further folded approximately 180 degrees such that the first and second front side portions 116, 118 surround and secure the first and second flaps 136, 142 therebetween. The first and second lateral side portions 124, 126 can thereby define the side walls, the front end portion 112 can define the front side wall, and the base portion 160 can define the food-supporting surface of the blank 100 when the blank 100 is folded into a container configuration.

As shown in FIG. 1 and the detailed view of FIG. 2, in some embodiments, the blank 100 can include first and second partial cuts 200, 202, e.g., rectangular cuts, along the front lateral hinge fold line 114. Thus, when the second front side portion 118 is rotated along the front lateral hinge fold line 114, the first and second partial cuts 200, 202 can create two openings along the front lateral hinge fold line 114. The front outer edge of the first front side portion 116 can include first and second protrusions 204, 206 extending therefrom and aligned with the first and second partial cuts 200, 202 in the blank 100. The first and second protrusions 204, 206 can be formed in a complementary manner relative to the first and second partial cuts 200, 202, such that when the first and second front side portions 116, 118 are folded around the first and second flaps 136, 142, the first and second protrusions 204, 206 can interlock relative to the openings formed from the first and second partial cuts 200, 202 to maintain the first and second flaps 136, 142 in the folded configuration.

The front outer edge of the first front side portion 116 can include at least one cut-out, e.g., a half-moon cut-out, a rectangular cut-out, a square cut-out, a circular cut-out, and the like. As shown, the first front side portion 116 includes first and second cut-outs 208*a*, 208*b*. The cut-outs can be adapted to assist in unfolding the blank 100 from the container configuration to the unfolded configuration. For example, the first and second cut-outs 208*a*, 208*b* can provide a grasping means for a user to release the engagement between the first and second protrusions 204, 206 and the openings formed from the first and second partial cuts 200, 202. Thus, the first and second cut-outs 208*a*, 208*b* can be used to slightly lift the first front side portion 116 to retract the first and second protrusions 204, 206 from the openings. In some embodiments, the front end portion 112 includes a cut-out (e.g., a circular cut-out 210) positioned at an intersection of the double front hinge fold lines 120, 122 and the lengthwise fold line 164. It should be understood that when the first and second front side portions 116, 118 are folded around the first and second flaps 136, 142, the circular cut-out 210 can form a half-moon cut-out shape to assist a user in opening the top portion 162, e.g., the lid portion, relative to the lower panel 102 when the blank 100 is in a container configuration.

The third lateral side portion 148 can be folded inwardly along the second part of the first side hinge fold line 130*a* in the direction of the top portion 162 such that the third lateral side portion 148 is positioned at approximately 90 degrees relative to the top portion 162. The back end portion 156 can be folded inwardly along the third lateral hinge fold line 158 in the direction of the top portion 148 such that the back end portion 156 is positioned at approximately 90 degrees relative to the top portion 162. The fourth lateral side portion 150 can be folded inwardly along the second part of the second side hinge fold line 134*b* in the direction of the top portion 162 such that the fourth lateral side portion 150 is positioned at approximately 90 degrees relative to the top portion 162.

The hinge portion 106 can then be rotated in the direction of the base portion 160 along the first lateral hinge fold line 108 such that the first and second middle flaps 128, 132 are positioned adjacent to the inner surface of the hinge portion 106 and the base portion 160. The hinge portion 106 can thereby define the back side wall of the blank 100 when the blank 100 is folded into the container configuration. In particular, the hinge portion 106 and the folded front end portion 112 can face each other and be substantially parallel relative to each other. Similarly, the first and second lateral side portions 124, 126 can face each other and be substantially parallel relative to each other.

The top portion 162 can then be rotated in the direction of the base portion 160 along the second lateral hinge fold line 110 such that the third and fourth lateral side portions 148, 150 and the back end portion 156 are positioned adjacent to and within the side walls formed by the front end portion 112 and the first and second lateral side portions 124, 126. In some embodiments, the second lateral hinge fold line 110 can include first and second partial cuts 216, 218, e.g., rectangular cuts, along the second lateral hinge fold line 110. Thus, when the top portion 162 is rotated along the second lateral hinge fold line 110, the first and second partial cuts 216, 218 can create two openings in the hinge portion 106 along the second lateral hinge fold line 110. The top portion 162 can thereby define the lid or cover of the blank 100 when the blank 100 is folded into the container configuration.

Figure 3:
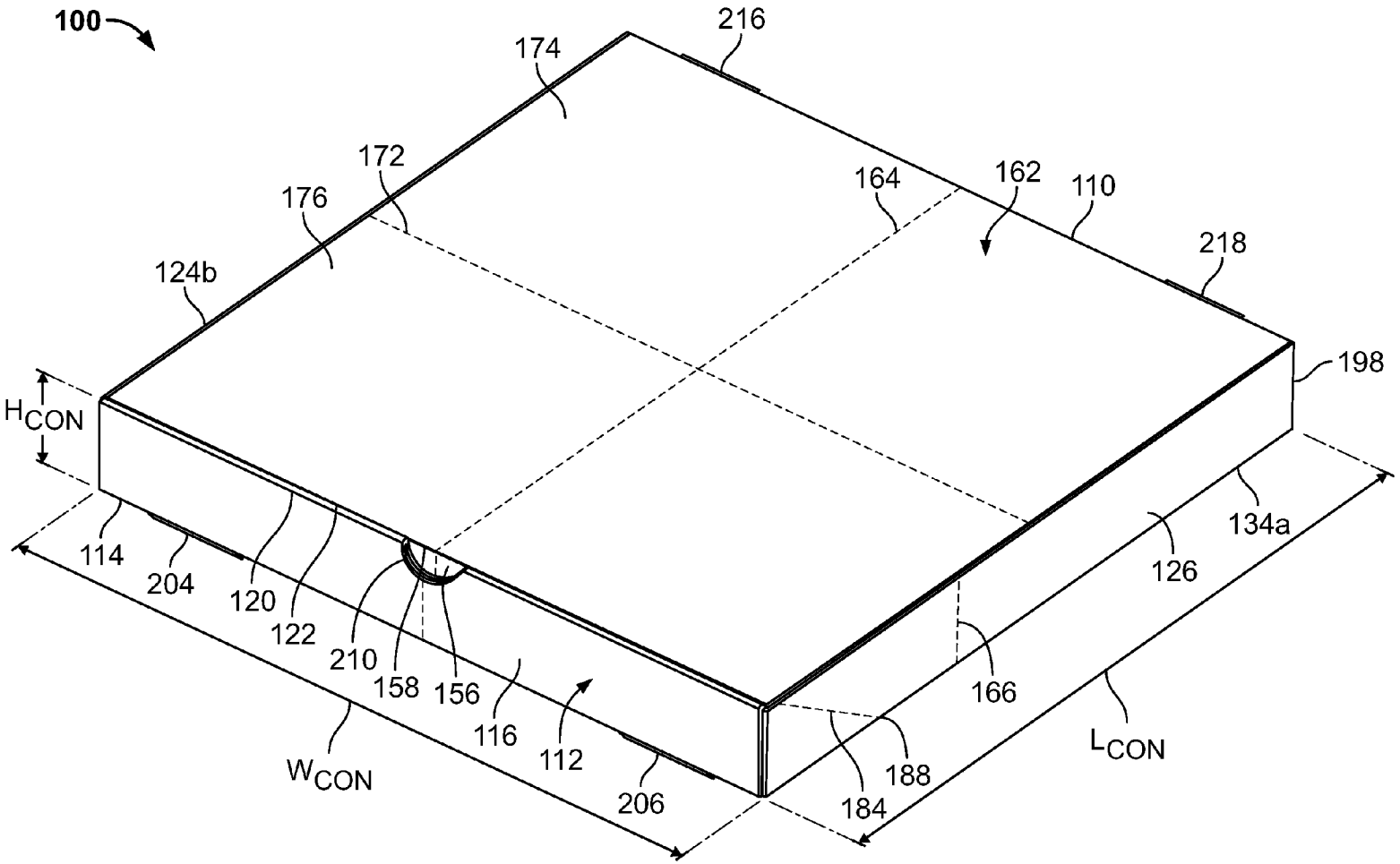
FIG. 3 is a perspective view of the blank of FIG. 1 in a container configuration.

FIG. 3 shows a perspective view of the exemplary blank 100 described above and folded into the container configuration. The blank 100 folded into the container configuration has a container length $L_{CON}$, a container width $W_{CON}$ and a container height $H_{CON}$. It should be understood that the circular cut-out 210 formed in the front end portion 112 creates a space between the front end portion 112 and the back end portion 156 configured and dimensioned to receive one or more fingers of a user for grasping the back end portion 156 and rotating the top portion 162 away from the base portion 160 to open the container. Thus, the top portion 162 can be rotated along the second lateral hinge fold line 110 to allow access to the contents of the container and to reseal the container for storage of food. As discussed above, in the container configuration, the blank 100 provides sufficient structure and support for food placed on the base portion 160.

Figure 4:
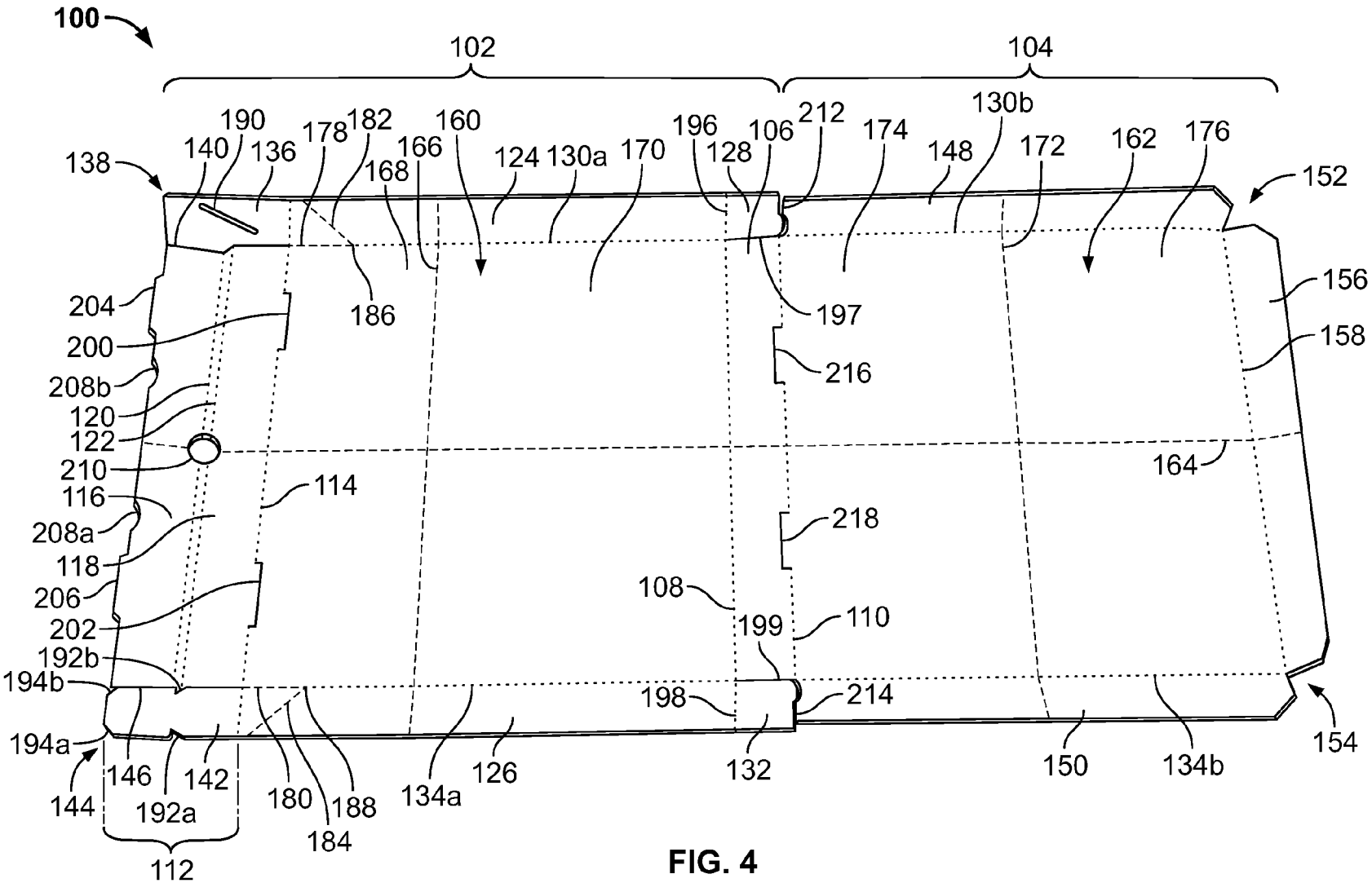
FIG. 4 is a top view of the blank of FIG. 1 in an unfolded configuration.

Turning now to FIG. 4, after the food stored in the container configuration of the blank 100 has been consumed or moved to a different location, the blank 100 can be unfolded completely into an unfolded configuration, e.g., a substantially flat configuration, in preparation for re-folding the blank 100 into the collapsed configuration for disposal. Those of ordinary skill in the art should understand that unfolding the blank 100 from the container configuration into the unfolded configuration requires a reversal of the steps described above for folding the blank 100 into the container configuration. For example, the upper panel 104 can be rotated away from the base portion 160 and the third and fourth lateral side portions 148, 150 and the back end portion 156 can be folded away from the hinge portion 106 and the top portion 162, respectively, into a substantially flat orientation. Similarly, the first and second front side portions 116, 118 of the front end portion 112 can be disengaged and unfolded relative to the first and second flaps 136, 142 by utilizing the cut-outs 208. The first and second flaps 136, 142, the first and second middle flaps 128, 132, and the first and second lateral side portions 124, 126 can also be unfolded and positioned in a substantially flat orientation. As explained above, the first and second cut-outs 208*a*, 208*b* can provide a grasping means for a user to release the engagement between the first and second protrusions 204, 206 and the openings formed from the first and second partial cuts 200, 202. Thus, the first and second cut-outs 208*a*, 208*b* can be used to slightly lift the first front side portion 116 to retract the first and second protrusions 204, 206 from the respective openings thereby facilitating the unfolding of the blank 100 from the container configuration to the unfolded configuration. Thus, the orientation and configuration of the blank 100 can be substantially returned to the initial orientation and configuration of the blank 100 shown in FIG. 1, except that the first flap 136 and the second flap 142 have been separated from the second front side portion 118.

Figure 5:
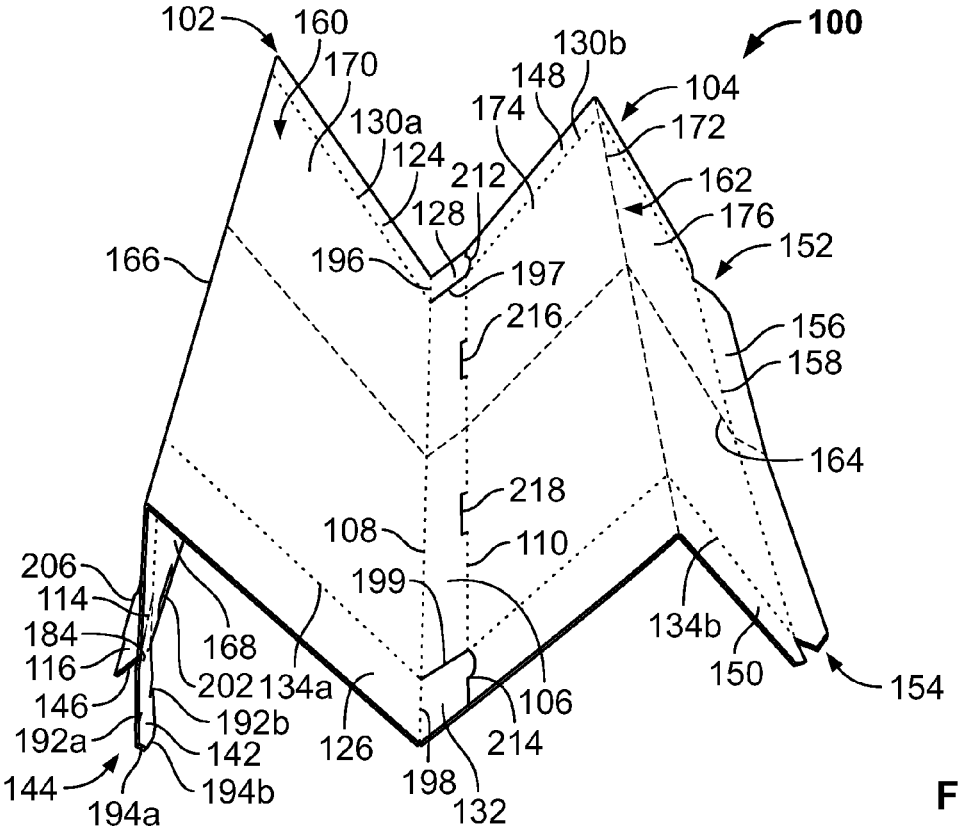
FIG. 5 is a perspective view of the blank of FIG. 1 in being folded into an accordion-type partially collapsed configuration.

The blank 100 can be re-folded from the unfolded configuration depicted in FIG. 5 to a stable collapsed configuration as shown in FIGS. 5-10. With reference to FIG. 5, the unfolded blank 100 is initially folded along the first and second lateral fold lines 166, 172, and the first lateral hinge fold line 108 into an accordion-shaped configuration. In particular, the accordion-shaped configuration of the blank 100 can define two "mountain" folds at the first and second lateral fold lines 166, 172 and one "valley" fold at the first lateral hinge fold line 108. For example, the blank 100 can be folded along the first lateral fold line 166 such that the outer surfaces of the lower panel 102 are positioned adjacent to each other and the inner surfaces of the lower panel 102, e.g., the first part 168 and the second part 170 of the base portion 160, face away from each other. The upside-down V-shaped fold at the first lateral fold line 166 can therefore define the first "mountain" fold. The blank 100 can be folded along the second lateral fold line 172 such that the outer surfaces of the upper panel 104 are positioned adjacent to each other and the inner surfaces of the upper panel 104, e.g., the first part 174 and the second part 176 of the top portion 162, face away from each other. The upside-down V-shaped fold at the second lateral fold line 172 can therefore define the second "mountain" fold. The blank 100 can further be folded along the first lateral hinge fold line 108 such that the second part 170 of the base portion 160 and the first part 174 of the top portion 162 face each other. The V-shaped fold at the first lateral hinge fold line 108 can therefore define the "valley" fold.

Figure 6:
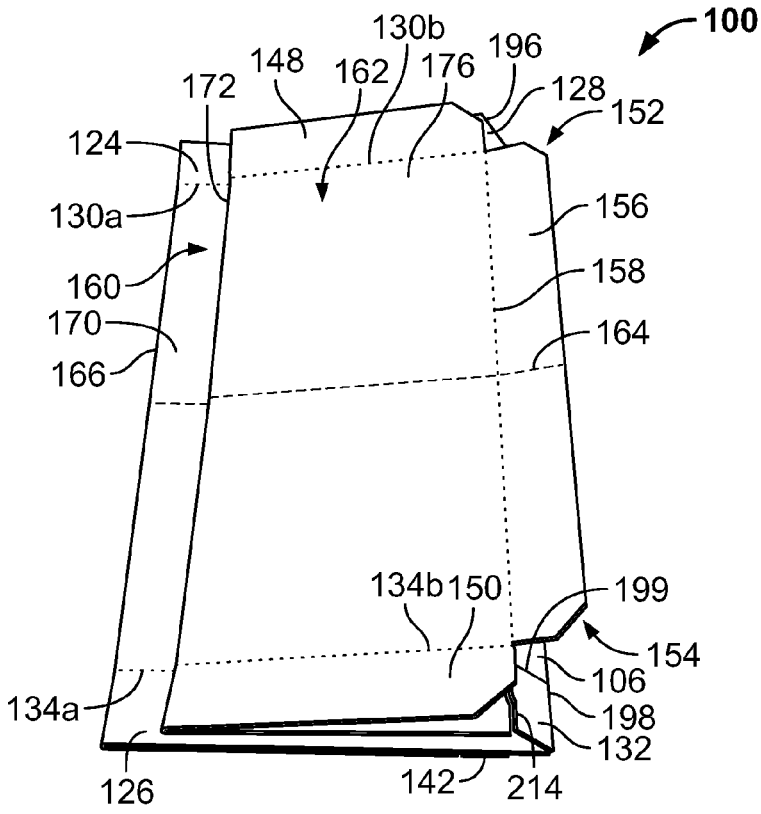
FIG. 6 is a perspective view of the blank of FIG. 1 in a in an accordion-type partially collapsed configuration.

As shown in FIG. 6, the accordion-shaped blank 100 folded at the first and second lateral fold lines 166, 172 and the first lateral hinge fold line 108 can be flattened into a substantially flat configuration. In particular, the blank 100 can be folded such that the outer surfaces of the lower panel 102 are positioned adjacent to each other, the second part 170 of the base portion 160 is positioned adjacent to the first part 174 of the top portion 162, and the outer surfaces of the upper panel 104 are positioned adjacent to each other. FIG. 6 shows the partially-collapsed blank 100 with the second part 176 of the top portion 162 facing upward.

Figure 7:
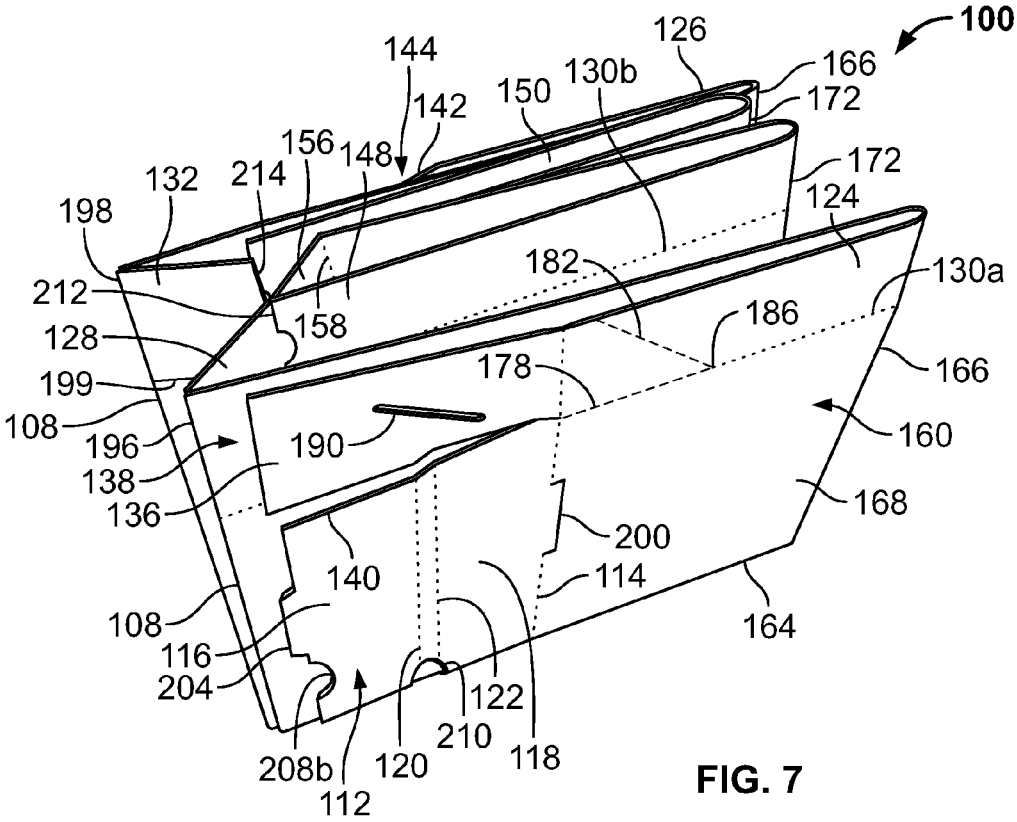
FIG. 7 is a perspective view of the blank of FIG. 1 in a fully collapsed configuration.

With reference to FIG. 7, the partially-collapsed blank 100 can further be folded along the lengthwise fold line 164, thereby folding the blank 100 into the fully collapsed configuration. In particular, the blank 100 can be folded along the lengthwise fold line 164 such that the inner surfaces of the two halves of the second part 176 of the top portion 162 are positioned adjacent to each other and the inner surfaces of the two halves of the first part 168 of the base portion 160 face away from each other. Folding the blank 100 along the lengthwise fold line 164 in this manner allows access to the first and second flaps 136, 142.

Figure 8:
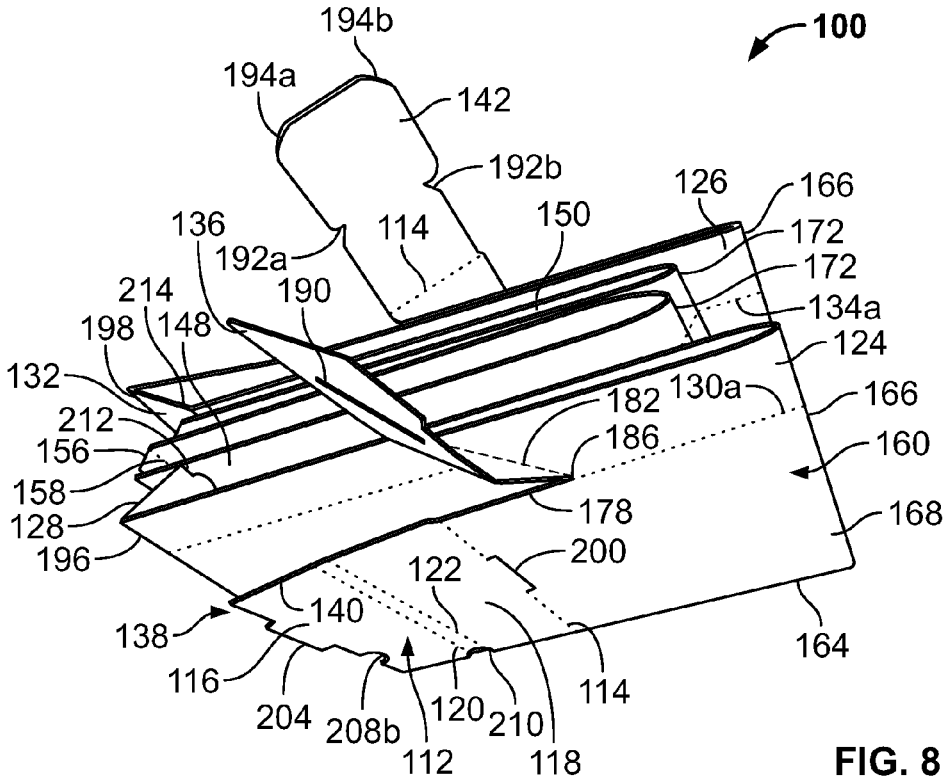
FIG. 8 is a perspective view of the blank of FIG. 1 in a collapsed configuration including extended flaps prior to interlocking of the flaps.

FIG. 8 shows the first and second flaps 136, 142 extended from the collapsed blank 100. In particular, and as described above, the blank 100 can be torn or separated along the first and second perforated lengthwise fold lines 178, 180 from the front lateral hinge fold line 114 to the endpoints 186, 188, respectively. The separation between the first and second flaps 136, 142 and the first and second front side portions 116, 118 can thereby be extended to a partial separation from the first part 168 of the base portion 160. The first and second flaps 136, 142 can be rotated along the first and second diagonal fold lines 182, 184, respectively, to extend away from the rest of the fully collapsed blank 100.

Figure 9:
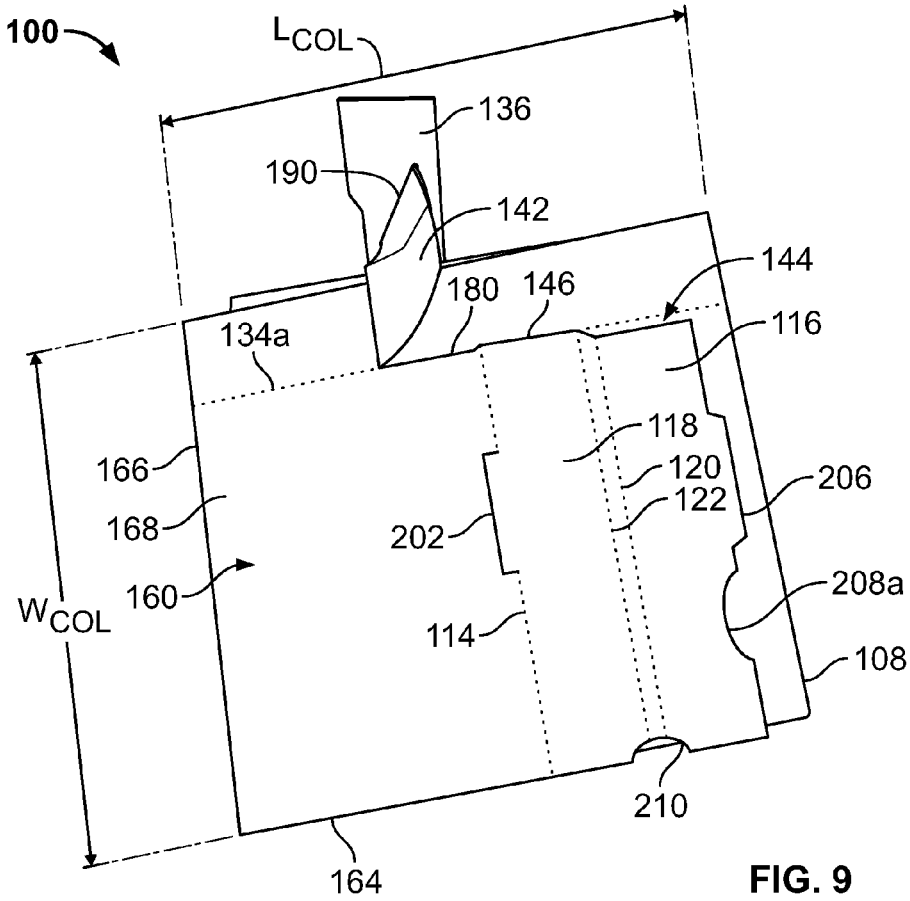
FIG. 9 is a first perspective view of the blank of FIG. 1 in a collapsed configuration including interlocked flaps in accordance with a first embodiment of an interlocking mechanism.
Figure 10:
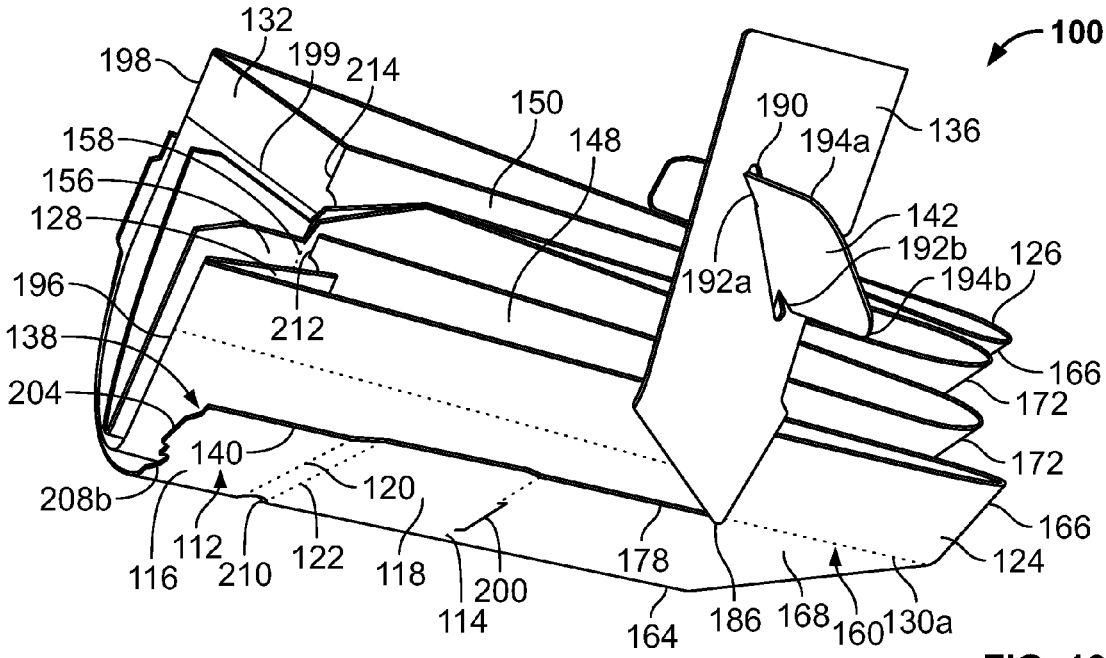
FIG. 10 is a second perspective view of the blank of FIG. 1 in a collapsed configuration including interlocked flaps in accordance with the first embodiment of an interlocking mechanism.

As shown in FIGS. 9 and 10, once the first and second flaps 136, 142 are extended from the rest of the fully collapsed blank 100, the second flap 142 can be partially passed through the slot 190 of the first flap 136 and the notches 192 of the second flap 142 engaged with the sides of the slot 190 to prevent separation of the first flap 136 relative to the second flap 142. In particular, the notches 192 can prevent the second flap 142 from withdrawing out of the slot 190. The "belt loop" interlocking mechanism between the first and second flaps 136, 142 thereby maintains the fully collapsed blank 100 in a stable configuration, specifically releasably locked in the fully collapsed configuration, and prevents undesired separation and/or unfolding of the blank 100 during disposal. In some embodiments, once the first and second flaps 136, 142 have been interlocked, the force on the first and second flaps 136, 142 from the stress stored in the folds of the collapsed blank 100 maintains the notches 192 engaged with the slot 190 to prevent the second flap 142 from disengaging the first flap 136. The efficiently collapsed blank 100 can thereby be disposed of in various locations due to the reduced size.

In particular, as shown in FIG. 9, by re-folding the blank 100 into the collapsed configuration, the blank 100 can be compactly and conveniently collapsed for disposal. In some embodiments, the collapsed length $L_{COL}$ of the blank 100 in the collapsed configuration, excluding first and second flaps 136, 142, can be between approximately 40 percent and approximately 60 percent of the length $L_{CON}$ of the blank 100 in the container configuration. In some embodiments, the collapsed length $L_{COL}$ of the blank 100 in the collapsed configuration can be between approximately 45 percent and approximately 55 percent of the length $L_{CON}$ of the blank 100 in the container configuration. In some embodiments, the collapsed length $L_{COL}$ of the blank 100 in the collapsed configuration can be approximately 50 percent of the length $L_{CON}$ of the blank 100 in the container configuration.

Similarly, the collapsed width $W_{COL}$ of the blank 100 in the collapsed configuration, excluding first and second flaps 136, 142, can be between approximately 40 percent and approximately 60 percent of the width $W_{CON}$ of the blank 100 in the container configuration. In some embodiments, the collapsed width $W_{COL}$ of the blank 100 in the collapsed configuration can be between approximately 45 percent and approximately 55 percent of the width $W_{CON}$ of the blank 100 in the container configuration. In some embodiments, the collapsed width $W_{COL}$ of the blank 100 in the collapsed configuration can be approximately 50 percent of the width $W_{CON}$ of the blank 100 in the container configuration. Thus, it should be understood that the exemplary blank 100 can be advantageously collapsed into a compact collapsed configuration for disposal.

Figure 11:
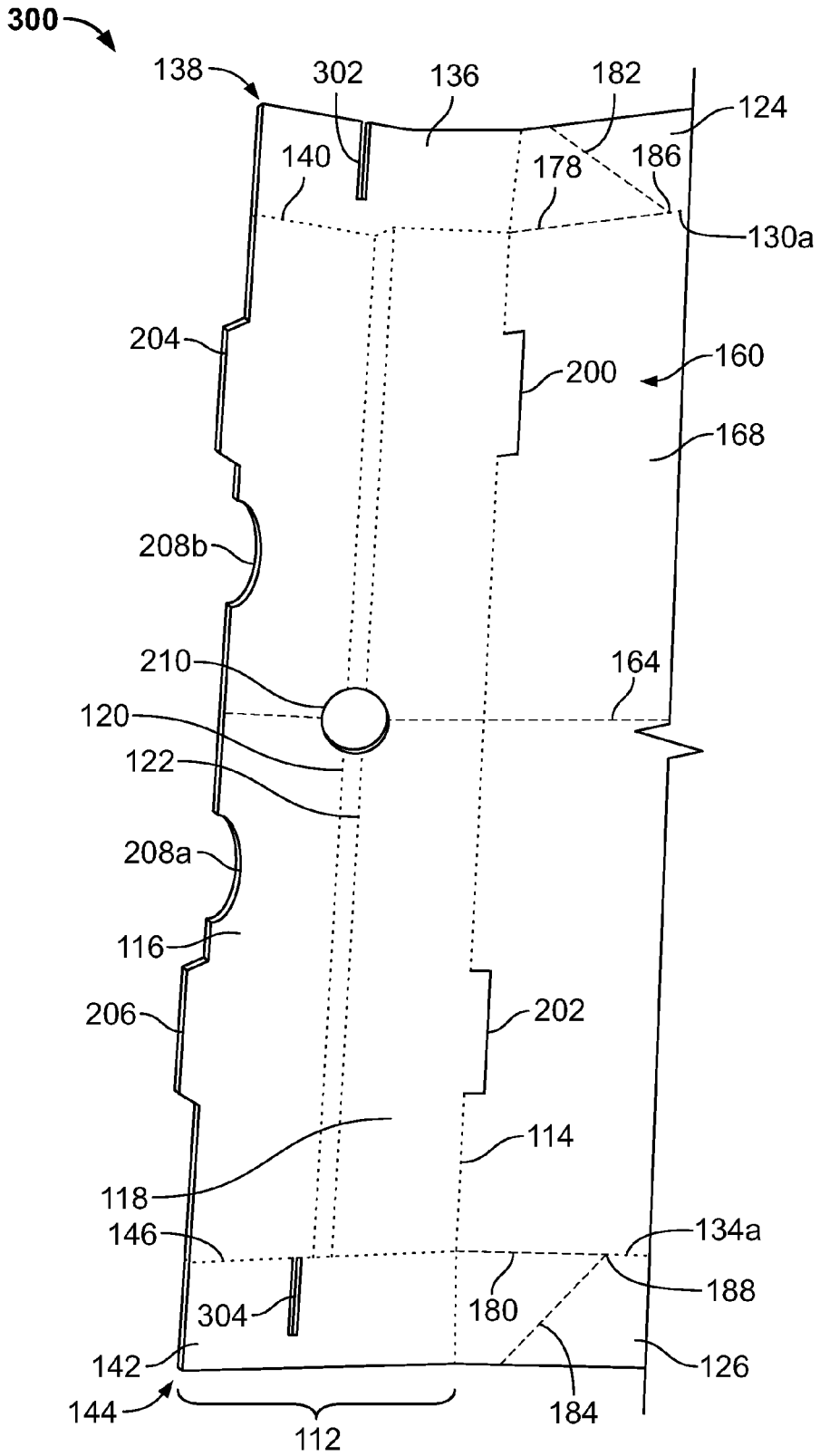
FIG. 11 is a detail, top view of a second embodiment of a blank in an unfolded configuration with the blank including a second embodiment of an interlocking mechanism according to the present disclosure.

Turning now to FIG. 11, a detail, top view of an exemplary blank 300 is provided. It should be understood that the structure and function of the blank 300 can be substantially similar to that of the blank 100, except for the distinctions noted herein. Therefore, like structures are indicated with like reference numbers.

In particular, rather than employing a slot 190 and notches 192 on the first and second flaps 136, 142, respectively, the blank 300 of FIG. 11 includes a second embodiment of the interlocking mechanism of the first and second flaps 136, 142. For example, the first flap 136 can include at least one notch (e.g., first flap notch 302) and the second flap 142 can include at least one notch (e.g., second flap notch 304) formed therein. The first flap notch 302 can be formed from the outer edge of the first lateral side portion 124 of first flap 302 and extend partially through the width of the first flap 136 in the direction of the first part of the first side hinge fold line 130*a*. The second flap notch 304 can be formed from the first part of the second side hinge fold line 134*b* and extend partially through the width of the second flap 142 in the direction of the outer edge of the second lateral side portion 126. Although depicted as substantially linear, it should be understood that the notches 302, 304 can be angled, curved, jagged or have another suitable shape.

It should be noted that the first and second notches 302, 304 can be oriented to face in a substantially similar direction. Thus, when the blank 300 has been re-folded into the collapsed configuration (e.g., similar to the collapsed configuration shown in FIG. 8) and the first and second flaps 136, 142 have been extended over the blank 300, the notches 302, 304 of the first and second flaps 136, 142 can be interlocked relative to each other to maintain the blank 300 in the collapsed configuration. In some embodiments, the first and/or second flap 136, 142 can include more than one notch 302, 304 to allow a user to select the position at which the first and second flaps 136, 142 can be interlocked. In some embodiments, once the first and second flaps 136, 142 have been interlocked, force on the first and second flaps 136, 142 from the stress stored in the folds of the collapsed blank 100 maintains engagement of the notches 302, 304 to prevent the first flap 136 from disengaging the second flap 142.

Figure 12:
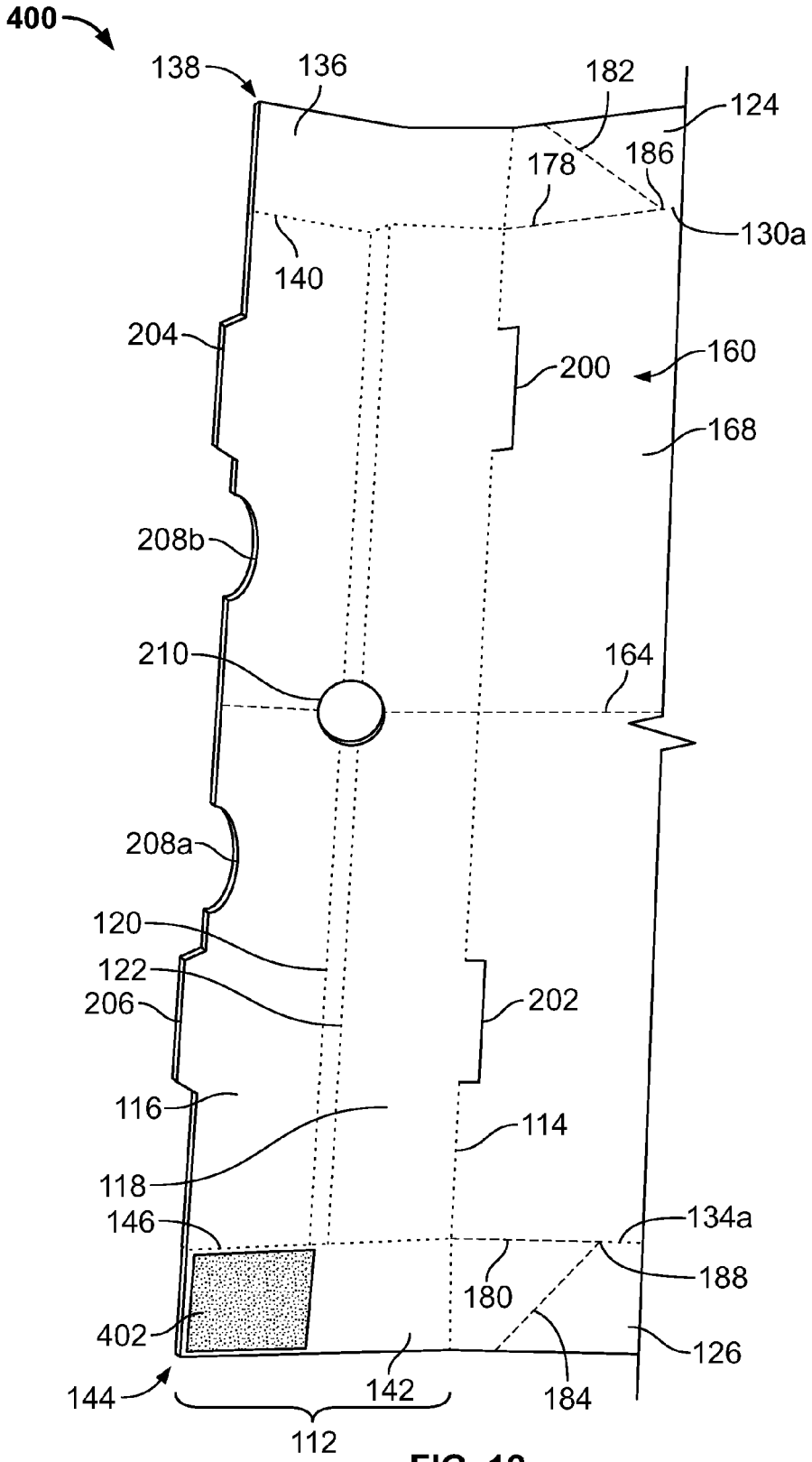
FIG. 12 is a detail, top view of a third embodiment of a blank in an unfolded configuration with the blank including a third embodiment of an interlocking mechanism according to the present disclosure.

Turning now to FIG. 12, a detail, top view of an exemplary blank 400 is provided. It should be understood that the structure and function of the blank 400 can be substantially similar to the blank 100, except for the distinctions noted herein. Therefore, like structures are indicated with like reference numbers.

In particular, rather than employing a slot 190 and notches 192 on the first and second flaps 136, 142, respectively, the blank 400 of FIG. 12 shows a third embodiment of the interlocking mechanism of the first and second flaps 136, 142. Either or both of the first flap 136 and the second flap 142 can include an adhesive. For example, as depicted, the second flap 142 includes an adhesive 402 on a surface of a portion of the second flap 142. In some embodiments, the adhesive 402 can be located on, e.g., the first flap 136, the first flap 136 and the second flap 142, and the like. In some embodiments, the adhesive 402 can be covered by a removable protective layer (not shown) during use of the blank 400 in the container configuration which can be removed from the adhesive 402 when the blank 400 is re-folded into the collapsed configuration.

Thus, when the blank 100 has been re-folded into the collapsed configuration (e.g., similar to the collapsed configuration shown in FIG. 8) and the first and second flaps 136, 142 have been extended over the blank 400, the first and second flaps 136, 142 can be interlocked relative to each other by adjoining the portion of the second flap 142 with the adhesive 402 to a surface of the first flap 136 to maintain the blank 400 in the collapsed configuration. In some embodiments, the strength of the adhesive 402 utilized can be determined based on the pressure created by the natural expansion of the blank 400 when in the collapsed configuration. In some embodiments, a first component of an adhesive may be disposed on the first flap 136 and a second component of an adhesive may be disposed on the second flap 142 such that first component and the second component adhere to each other upon contact. One of ordinary skill in the art would appreciate that other mechanisms for securing the blank 400 in a fully collapsed configuration may be incorporated into the first flap 136 and/or the second flap 142 without departing from the scope of the disclosure.

Figure 13:
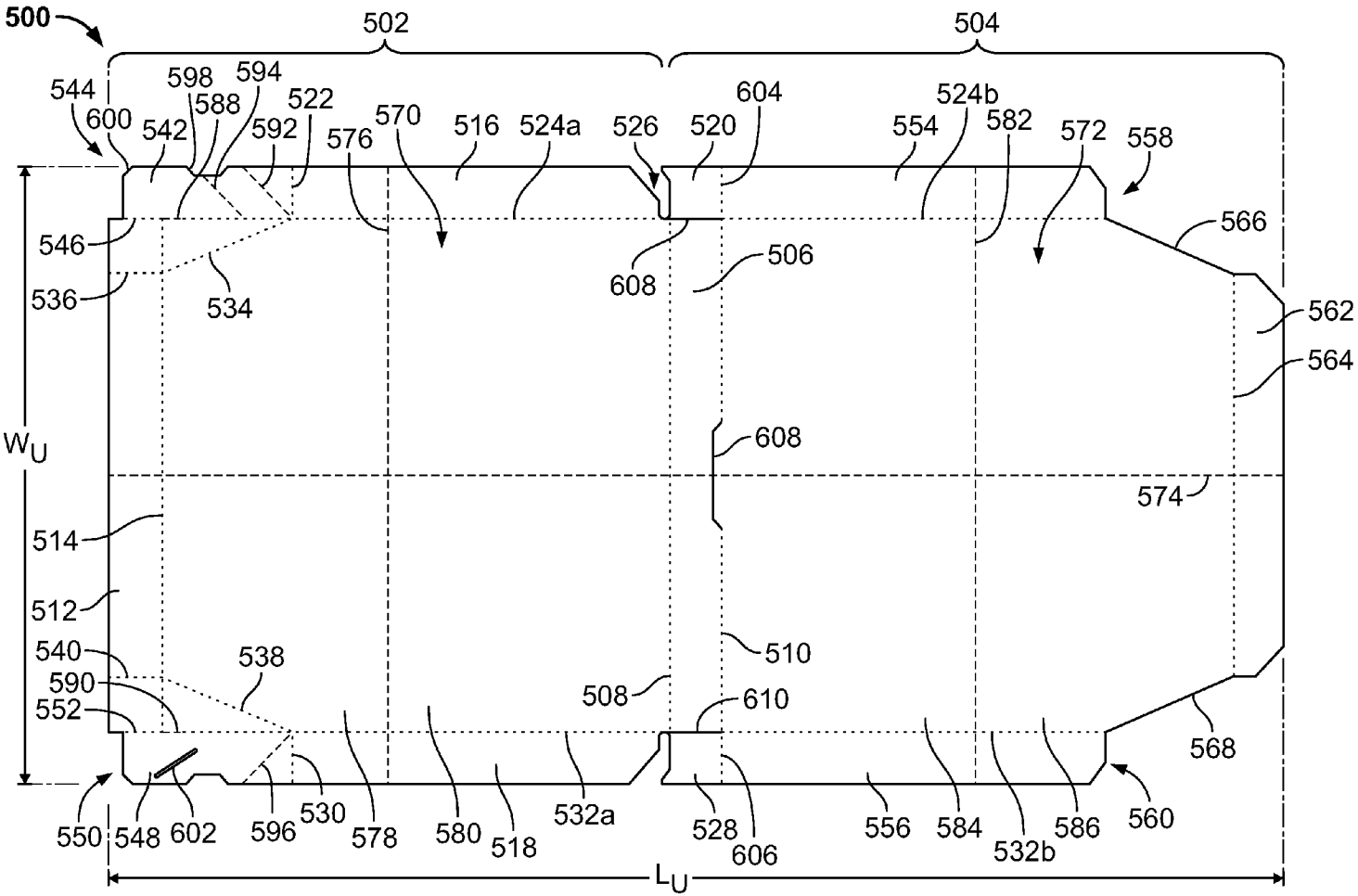
FIG. 13 is a top view of a fourth embodiment of a blank in an unfolded configuration according to the present disclosure.

Turning to FIG. 13, a top view of a blank 500 for a collapsible, folded container for food is provided, in accordance with another embodiment. Rather than defining a substantially square or rectangular container configuration, such as the blank 100, the blank 500 defines angled or chamfered sides on two corners when in a container configuration as discussed in greater detail below. It should be understood that the function of the fold lines of the blank 500 can be substantially similar to the function of the fold lines of the blank 100, with differences being notes below.

The blank 500 is adapted to be folded into a container configuration, unfolded into an unfolded configuration, and then folded into a stable, collapsed configuration. Before addressing additional fold lines and cut-outs that facilitate unfolding the blank 500 and then folding it into the collapsed configuration, the fold lines that facilitate initial folding of the blank 500 into the container configuration are described.

As shown in FIG. 13, the blank 500 defines an unfolded length $L_U$ and a width $W_U$ The blank 500 includes a lower panel 502 and an upper panel 504 hingedly connected relative to each other. In particular, the upper panel 504 includes a first hinge portion 506 which extends laterally across the blank 500 and is positioned between the lower panel 502 and the upper panel 504. For example, the first hinge portion 506 hingedly connects to the lower panel 502 at a first lateral hinge fold line 508 and hingedly connects to the upper panel 504 at a second lateral hinge fold line 510, thereby hingedly connecting the lower panel 502 to the upper panel 504.

The lower panel 502 includes a front end portion 512 hingedly connected to the lower panel 502 at a front lateral hinge fold line 514. The lower panel 502 includes a first lateral side portion 516 and a second lateral side portion 518. The first lateral side portion 516 extends between a first middle flap 520 of the hinge portion 506 and a first side lateral hinge fold line 522, and is hingedly connected to the blank 500 at a first part of a first lengthwise hinge fold line 524*a*. In some embodiments, the first lateral side portion 516 can be separated from the first middle flap 520 by a cut-out 526 formed in the blank 500. The second lateral side portion 518 can extend between a second middle flap 528 of the hinge portion 506 and a second side lateral hinge fold line 530, and can be hingedly connected to the blank 500 at a first part of a second lengthwise hinge fold line 532*b*. In some embodiments, the first part of the first and second lengthwise hinge fold lines 524*a*, 532*a* can be substantially aligned relative to a second part of a first and second lengthwise hinge fold line 524*b*, 532*b*, respectively, and can extend the entire length $L_U$ of the blank 500, except for the first and second middle flap cuts 608, 610, separating the first and second parts of the first and second lengthwise hinge fold lines 524*a*, 524*b*, 532*a*, 532*b* at the hinge portion 506.

A first diagonal fold line 534 can connect the first side lateral hinge fold line 522 to a first front lengthwise hinge fold line 536 formed in the front end portion 512. In particular, the first diagonal fold line 534 can be oriented diagonal relative to the first part of the first lengthwise hinge fold line 524*a* and the front lateral hinge fold line 514. Similarly, a second diagonal fold line 538 can connect the second side lateral hinge fold line 530 to a second front lengthwise hinge fold line 540 formed in the front end portion 512. The first and second front lengthwise hinge fold lines 536, 540 can be equally offset from a center of the front end portion 512 along the width $W_U$ of the blank 500. As shown in FIG. 13, the intersecting points of the first diagonal fold line 534, the front lateral hinge fold line 514 and the first part of the first lengthwise hinge fold line 524*a* can form a triangle. Similarly, the intersecting points of the second diagonal fold line 538, the front lateral hinge fold line 514 and the first part of the second lengthwise hinge fold line 532*a* can form a triangle.

The first lateral side portion 516 can include a first flap 542 disposed at a first corner 544 of the blank 500. In particular, for purposes of folding the blank 500 into the container configuration, the first flap 542 can be hingedly connected to the first lateral side portion 516 at the first side lateral hinge fold line 522, can be hingedly connected to the blank 500 along the first part of the first lengthwise hinge fold line 524*a*, and can be hingedly connected to the front end portion 512 along a first side lengthwise hinge fold line 546 which can be substantially in-line and parallel to the first part of the first lengthwise hinge fold line 524*a*.

Similarly, the second lateral side portion 518 can include a second flap 548 disposed at a second corner 550 of the blank 500. In particular, for purposes of folding the blank 500 into the container configuration, the second flap 548 can be hingedly connected to the second lateral side portion 518 at the second side lateral hinge fold line 530, can be hingedly connected to the blank 500 along the first part of the second lengthwise hinge fold line 532*a*, and can be hingedly connected to the front end portion 512 along a second side lengthwise hinge fold line 552 which can be substantially in-line and parallel to the first part of the second lengthwise hinge fold line 532*a*.

The upper panel 504 can include a third lateral side portion 554 and a fourth lateral side portion 556. The third lateral side portion 554 can extend in-line with and parallel to the first lateral side portion 516 and can extend between the first middle flap 520 of the hinge portion 506 and a third corner 558 of the blank 500. The third lateral side portion 554 can be hingedly connected to the blank 500 at the second part of the first lengthwise hinge fold line 524*b*. The fourth lateral side portion 556 can extend in-line with and parallel to the second lateral side portion 518 and can extend between the second middle flap 528 and a fourth corner 560 of the blank 500. The fourth lateral side portion 556 can be hingedly connected to the blank 500 at the second part of the second lengthwise hinge fold line 532*b*. The upper panel 504 can further include a back end portion 562 hingedly connected to the blank 500 at a third lateral hinge fold line 564. The third lateral hinge fold line 564 can be oriented perpendicular to the second part of the first and second lengthwise hinge fold lines 524*b*, 532*b*. In particular, the endpoint of the second part of the first lengthwise hinge fold line 524*b* at the third corner 558 can be connected to the third lateral hinge fold line 564 by a chamfered edge 566 oriented diagonally to the second part of the first lengthwise hinge fold line 524*b* and the third lateral hinge fold line 564. Similarly, the endpoint of the second part of the second lengthwise hinge fold line 532*b* at the fourth corner 560 can be connected to the third lateral hinge fold line 564 by a chamfered edge 568 oriented diagonally to the second part of the second lengthwise hinge fold line 532*b* and the third lateral hinge fold line 564.

The top surface of the blank 500 shown in FIG. 13 can be referred to as the inner surface of the blank 500 and the surface facing away from the viewer in FIG. 13 can be referred to as the outer surface of the blank 500. As noted previously, such a convention may be reversed. The area of the lower panel 502 bounded by the first part of the first and second lengthwise hinge fold lines 524*a*, 532*a*, the first and second lateral hinge fold lines 508, 514, and the first and second diagonal fold lines 534, 538 defines the base portion 570, e.g., the food-supporting surface, when the blank 500 is folded into the container configuration. Similarly, the area of the upper panel 504 bounded by the second part of the first and second lengthwise hinge fold lines 524*b*, 532*b*, the lateral hinge fold lines 510, 564, and the chamfered edges 566, 568 defines a top portion 572, e.g., the lid portion, which would be positioned above the food and opposite the base portion 570 when the blank 500 is folded into the container configuration and closed.

In addition to the fold lines discussed above that enable blank 500 to be folded into a container configuration, blank 500 includes additional fold lines and cutouts that facilitate unfolding the blank 500 from a container configuration to an unfolded configuration, and then refolding the blank 500 into a stable collapsed configuration, in accordance with some embodiments. As illustrated in FIG. 13, the blank 500 includes a lengthwise fold line 574 extending across the entire length $L_U$ of the blank 500. In particular, the lengthwise fold line 574 can extend across the lower panel 502, the hinge portion 506 and the upper panel 504. The lengthwise fold line 574 can be positioned at a central position along the width $W_U$ of the blank 500 such that the lengthwise fold line 574 divides the front end portion 512, the base portion 570, the hinge portion 506, the top portion 572 and the back end portion 562 into substantially equal areas, e.g., two substantially equal halves.

With respect to the lower panel 502, the blank 500 includes a first lateral fold line 576 extending laterally across the entire width $W_U$ of the blank 500 substantially perpendicular to the lengthwise fold line 574. In particular, the first lateral fold line 576 can divide the lower panel 502 into two substantially equal areas, e.g., two substantially equal halves. However, the first lateral fold line 576 can divide the base portion 570 into two unequal areas, e.g., an area of a first part 578 and an area of a second part 580, where the area of the second part 580 is dimensioned substantially larger than the area of the first part 578. Specifically, the area of the first part 578 can be defined by the intersecting portions of the first part of the first and second lengthwise hinge fold lines 524*a*, 532*a*, the lateral hinge fold line 514, the diagonal fold lines 534, 538 and the first lateral fold line 576. The area of the second part 580 can be defined by the intersecting portions of the first part of the first and second lengthwise hinge fold lines 524*a*, 532*a*, the front lateral hinge fold line 508 and the first lateral fold line 576. As shown in FIG. 13, the first lateral fold line 576 can be offset from a center of the base portion 570 such that the area of the second part 580 is substantially larger than the area of the first part 578. Thus, the distance from the first lateral hinge fold line 508 to the first lateral fold line 576 can be substantially greater than the distance from the first lateral fold line 576 to the front lateral hinge fold line 514.

With respect to the upper panel 504, the blank 500 can include a second lateral fold line 582 which extends laterally across entire width $W_U$ of the blank 500 substantially perpendicular to the lengthwise fold line 574. In particular, the second lateral fold line 582 can divide top portion 572 into a first part 584 and a second part 586 with the length of the first part being the same as a length of the second part. Specifically, the length of the first part 584 extends from the second lateral hinge fold line 510 to the second lateral fold line 582, and the length of the second part 586 extends from the second lateral fold line 582 to the third lateral hinge fold line 564. Thus, the distance from the second lateral hinge fold line 510 to the second lateral fold line 582 can be substantially equal to the distance from the second lateral fold line 582 to the third lateral hinge fold line 564.

In some embodiments, the first and second parts of the first and second lengthwise hinge fold lines 524*a*, 524*b*, 532*a*, 532*b* are aligned relative to each other and extend the entire length $L_U$ of the blank 500, except for the first and second middle flap cuts 608, 610 at the hinge portion 506. In the embodiment shown in FIG. 13, first and second perforated lengthwise fold lines 588, 590 are formed in the blank 500 as an extension of the first part of the first and second lengthwise hinge fold lines 524*a*, 532*a*. For example, with respect to the first part of the first lengthwise hinge fold line 524*a*, the first perforated lengthwise fold line 588 can be formed along the first part of the first lengthwise hinge fold line 524*a* starting from the front edge of the blank 500 and extending in the direction of the first lateral fold line 576. The second perforated lengthwise fold line 590 can be formed along the first part of the second lengthwise hinge fold line 532*a* starting from the front edge of the blank 500 and extending a partial distance in the direction of the first lateral fold line 576. In some embodiments, the first and second perforated lengthwise fold lines 588, 590 can extend less than halfway between the front lateral hinge fold line 514 and the first lateral fold line 576. In some embodiments, the first and second perforated lengthwise fold lines 588, 590 can be formed in the blank 500 with a more frequent pattern of perforations, e.g., approximately every 1/16 inches to 1/8 inches, to allow less resistance when tearing the blank 500 along the first and second perforated lengthwise fold lines 588, 590.

In the embodiment shown in FIG. 13, first and second diagonal fold lines 592, 594 are formed in the first lateral side portion 516, and a third diagonal fold line 596 is formed in the second lateral side portion 518 of the blank 500. The first second and third diagonal fold lines 592, 594, 596 are diagonal relative to the lengthwise fold line 574 and the first and second lateral fold lines 576, 582. For example, the first diagonal fold line 592 extends from an intersection of the first side lateral hinge fold line 522 and the first part of the first lengthwise hinge fold line 524*a*, at an approximately 45 degree angle to both, away from the base portion 570 to an outer edge of the first flap 542. In some embodiments, an optional second diagonal fold line 594 is formed parallel to the first diagonal fold line 592. For example, the second diagonal fold line 594, which is offset from the first diagonal fold line 592, extends from the first part of the first lengthwise hinge fold line 524*a* to an outer edge of the first flap 542.

Similarly, the third diagonal fold line 596 extends from an intersection of the second side lateral hinge fold line 530 and the first part of the second lengthwise hinge fold line 532*a*, at an approximately 45 degree angle to both, away from the base portion 570. In particular, the third diagonal fold line 596 can extend up to an outer edge of the second flap 548.

Still with reference to FIG. 13, the blank 500 is shown with the first embodiment of an interlocking mechanism for maintaining the blank 500 in the collapsed configuration which can be substantially similar to the interlocking mechanism described above with respect to FIG. 1. The interlocking mechanism can function by interaction between the first and second flaps 542, 548. For example, the first flap 542 can include a punch-out cut offset from the first corner 544, e.g., a punch-out cut at an outer edge of the first flap 542, to form a notch 598 in the first flap 542. Optionally, the first flap 542 can include one or more additional punch-out cuts at the first corner 544 of the first flap 542 to create a chamfered or rounded edge 600.

The second flap 548 can include a slot 602 formed therethrough to permit engagement with the first flap 542. In some embodiments, the slot 602 can be a rounded rectangular slot cut out of the blank 500. The slot 602 can be oriented diagonally relative to the lateral and lengthwise fold lines of the blank 500. The slot 602 of the second flap 548 can be configured and dimensioned to receive the first flap 542 at least partially therethrough up to the notch 598. In the collapsed configuration, the first flap 542 can be passed through the slot 602 such that the notch 598 engages the slot 602 and prevents the first flap 542 from disengaging from the second flap 548, thereby functioning as a lock or clip for the "belt loop" interlocking mechanism. The interlocking engagement between the first and second flaps 542, 548 can maintain the blank 500 in the collapsed configuration for disposal. Although shown as a "belt loop" interlocking mechanism, alternatively, the blank 500 can include the interlocking mechanism of FIG. 11 or FIG. 12.

During folding of the blank 500 into the container configuration, the first and second lateral side portions 516, 518 can be folded inwardly at the first part of the first and second lengthwise hinge fold lines 524*a*, 532*a*, respectively, such that the first and second lateral side portions 516, 518 are positioned at approximately 90 degrees relative to the base portion 570. The front end portion 512 can further be folded inwardly along the front lateral hinge fold line 514 such that the front end portion 512 is positioned at approximately 90 degrees relative to the base portion 570. The first and second corners 544, 550 can be folded by folding the blank along the first and second diagonal fold lines 534, 538 such that the blank 500 defines chamfered corners at the first and second corners 544, 550. The first and second lateral side portions 516, 518 can thereby define the side walls, the front end portion 512 can define the front side wall, the first and second flaps 542, 548 can define the chamfered corners, and the base portion 570 can define the food-supporting surface of the blank 500 when the blank 500 is folded into a container configuration.

The first middle flap 520 can be separated from the hinge portion 506 along the first middle flap cut 608, thereby remaining hingedly connected to the third lateral side portion 554 at the third lateral fold line 604. In some embodiments, the first middle flap cut 608 can be aligned relative to the first and second parts of the first lengthwise hinge fold line 524*a*, 524*b*. In some embodiments, the first middle flap cut 608 can extend the entire length between the first and second parts of the first lengthwise hinge fold line 524*a*, 524*b*. In some embodiments, the first middle flap cut 608 can include a thin, e.g., approximately 1/16 inch, temporary connection between the first middle flap 520 and the hinge portion 506 centrally positioned along the first middle flap cut 608. The first middle flap 520 can thereby be partially connected to the hinge portion 506 and can be separated from the hinge portion 506 by tearing the temporary connection. In some embodiments, the third lateral fold line 604 can be aligned with the second lateral hinge fold line 510 and can extend from the second part of the first lengthwise hinge fold line 524*b* to the outer edge of the blank 500. In some embodiments, the third lateral fold line 604 can be a substantially linear cut.

Similarly, the second middle flap 528 can be separated from the hinge portion 506 along the second middle flap cut 610, thereby remaining hingedly connected to the fourth lateral side portion 556 at the fourth lateral fold line 606. In some embodiments, the second middle flap cut 610 can be aligned relative to the first and second parts of the second lengthwise hinge fold line 532*a*, 532*b*. In some embodiments, the second middle flap cut 610 can extend the entire length between the first and second parts of the second lengthwise hinge fold line 532*a*, 532*b*. In some embodiments, the second middle flap cut 610 can include a thin, e.g., approximately 1/16 inch, temporary connection between the second middle flap 528 and the hinge portion 506 centrally positioned along the second middle flap cut 610. The second middle flap 528 can thereby be partially connected to the hinge portion 506 and can be separated from the hinge portion 506 by tearing the temporary connection. In some embodiments, the fourth lateral fold line 606 can be aligned with the second lateral hinge fold line 510 and can extend from the second part of the second lengthwise hinge fold line 532*b* to the outer edge of the blank 500. In some embodiments, the fourth lateral fold line 606 can be a substantially linear cut.

The third lateral side portion 554 can be folded inwardly along the second part of the first lengthwise hinge fold line 524*b* until the third lateral side portion 554 and the first middle flap 520 are positioned at approximately 90 degrees relative to the top portion 572. The first middle flap 520 can be folded inwardly along the third lateral fold line 604 in the direction of the hinge portion 506 such that the first middle flap 520 is positioned at approximately 90 degrees relative to the hinge portion 506 and is aligned with the second lateral hinge fold line 510.

Similarly, the fourth lateral side portion 556 can be folded inwardly along the second part of the second lengthwise fold line 532*b* until the fourth lateral side portion 556 and the second middle flap 528 are positioned at approximately 90 degrees relative to the top portion 572. The second middle flap 528 can be folded inwardly along the fourth lateral fold line 606 in the direction of the hinge portion 506 such that the second middle flap 528 is positioned at approximately 90 degrees relative to the hinge portion 506 and is aligned with the second lateral hinge fold line 510. The back end portion 562 can be folded inwardly along the third lateral hinge fold line 564 in the direction of the top portion 572 such that the back end portion 562 is positioned at approximately 90 degrees relative to the top portion 572.

The hinge portion 506 can then be rotated in the direction of the base portion 570 along the first lateral hinge fold line 508 such that the first and second middle flaps 520, 528 are positioned adjacent to the inner surface of the hinge portion 506 and the top portion 572. The hinge portion 506 can thereby define the back side wall of the blank 500 when the blank 500 is folded into the container configuration. In particular, the hinge portion 506 and the folded front end portion 512 can face each other and be substantially parallel relative to each other. Similarly, the first and second lateral side portions 516, 518 can face each other and be substantially parallel relative to each other.

The top portion 572 can then be rotated in the direction of the base portion 570 along the second lateral hinge fold line 510 such that the third and fourth lateral side portions 554, 556 and the back end portion 562 are positioned adjacent to and within the side walls formed by the front end portion 512 and the first and second lateral side portions 516, 518. In some embodiments, the second lateral hinge fold line 510 can include one or more partial cuts 608, e.g., rectangular cuts, along the second lateral hinge fold line 510. Thus, when the top portion 572 is rotated along the lateral hinge fold line 510, the partial cut 608 creates an opening in the hinge portion 506 along the second lateral hinge fold line 510. The top portion 572 defines the lid or cover of the blank 500 when the blank 500 is folded into the container configuration.

After the food stored in the container configuration of the blank 500 has been consumed or moved to a different location, the blank 500 can be unfolded completely into an unfolded configuration, e.g., a substantially flat configuration, in preparation for re-folding the blank 500 into the collapsed configuration for disposal. Those of ordinary skill in the art should understand that unfolding the blank 500 from the container configuration into the unfolded configuration requires a reversal of the steps described above for folding the blank 500 into the container configuration. Thus, the orientation and configuration of the blank 500 can be substantially returned to the initial orientation and configuration of the blank 500 shown in FIG. 13.

From the unfolded configuration, the blank 500 can be re-folded into the collapsed configuration by following the procedures described above with respect to the blank 100. For example, the blank 500 can be folded along the first and second lateral fold lines 576, 582, and the first lateral hinge fold line 508 into an accordion-shaped configuration, e.g., two "mountain" folds at the first and second lateral fold lines 576, 582 and a "valley" fold at the lateral hinge fold line 508. The accordion-shaped blank 500 can be flattened into the partially-collapsed configuration.

The partially-collapsed blank 500 can further be folded along the lengthwise fold line 574, thereby folding the blank 500 into the fully collapsed configuration. In particular, the blank 500 can be folded along the lengthwise fold line 574 such that the inner surfaces of the two halves of the second part 586 of the top portion 572 are positioned adjacent to each other and the inner surfaces of the two halves of the first part 578 of the base portion 570 face away from each other. Folding the blank 500 along the lengthwise fold line 574 in this manner allows access to the first and second flaps 542, 548.

With respect to the first flap 542, the blank 500 can be separated or torn along the first side lengthwise hinge fold line 546, the first perforated lengthwise fold line 588, and the first part of the first lengthwise hinge fold line 524*a* up to the intersection between the first side lateral hinge fold line 522 and the first diagonal fold line 534. In some embodiments, the first side lengthwise hinge fold line 546 can be formed as a perforated line or can include only a few points of attachment relative to the front end portion 512. The first flap 542 can thereby be separated from the front end portion 512 and the first part 578 of the base portion 570, while remaining hingedly connected to the first lateral side portion 516 along the first side lateral hinge fold line 522. Similarly, with respect to the second flap 548, the blank 500 can be separated or torn along the second side lengthwise hinge fold line 552, the second perforated lengthwise fold line 590, and the first part of the second lengthwise hinge fold line 532*a* up to the intersection between the second side lateral hinge fold line 530 and the second diagonal hinge fold line 538. In some embodiments, the second side lengthwise hinge fold line 552 can be formed as a perforated line or can include only a few points of attachment relative to the front end portion 512. The second flap 548 can thereby be separated from the front end portion 512 and the first part 578 of the base portion 570, while remaining hingedly connected to the second lateral side portion 518 along the second side lateral hinge fold line 530.

Once the blank 500 has been re-folded into the collapsed configuration, the first and second flaps 542, 548 can be extended from the collapsed blank 500 by rotating or bending the first and second flaps 542, 548 at the diagonal fold lines first second and third diagonal fold lines 592, 594, 596 and the first and second side lateral hinge fold lines 522, 530. The first flap 542 can then be partially passed through the slot 602 of the second flap 548 and the notch 598 of the first flap 542 can be engaged with the sides of the slot 602 to prevent separation of the first flap 542 relative to the second flap 548 and secure the blank 500 in the collapsed configuration. In some embodiments, once the first and second flaps 542, 548 have been interlocked, the force on the first and second flaps 542, 548 from the stress stored in the folds of the collapsed blank 500 maintains the notch 598 engaged with the slot 602 to prevent the first flap 542 from disengaging from the second flap 548. The efficiently collapsed blank 500 can thereby be disposed of in various locations due to the reduced size.

In particular, by re-folding the blank 500 into the collapsed configuration, the blank 500 can be compactly and conveniently collapsed for disposal. In some embodiments, similar to FIG. 9, the collapsed length of the blank 500 in the collapsed configuration can be between approximately 40 percent and approximately 60 percent of the length of the blank 500 in the container configuration. In some embodiments, the collapsed length of the blank 500 in the collapsed configuration can be between approximately 45 percent and approximately 55 percent of the length of the blank 500 in the container configuration. In some embodiments, the collapsed length of the blank 500 in the collapsed configuration can be approximately 50 percent of the length of the blank 500 in the container configuration.

Similarly, the collapsed width of the blank 500 in the collapsed configuration can be between approximately 40 percent and approximately 60 percent of the width of the blank 500 in the container configuration. In some embodiments, the collapsed width of the blank 500 in the collapsed configuration can be between approximately 45 percent and approximately 55 percent of the width of the blank 500 in the container configuration. In some embodiments, the collapsed width of the blank 500 in the collapsed configuration can be approximately 50 percent of the width of the blank 500 in the container configuration. Thus, it should be understood that the exemplary blank 500 can be advantageously collapsed into a compact collapsed configuration for disposal.

Figure 14:
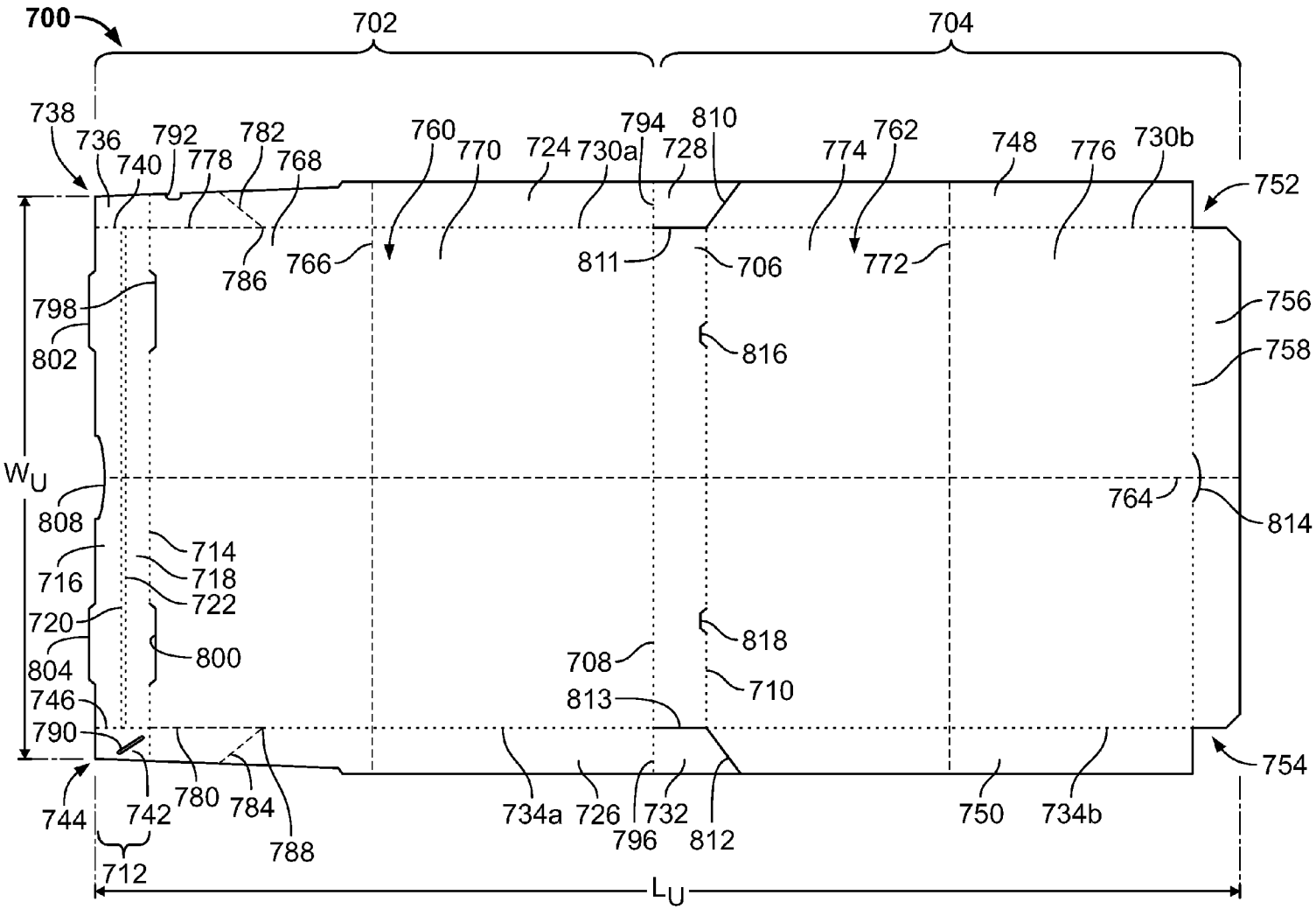
FIG. 14 is a top view of a fifth embodiment of a blank in an unfolded configuration according to the present disclosure.

Turning to FIG. 14, a top view of a blank 700 for a collapsible, folded container for food is provided, in accordance with another embodiment. Although the blank 700 will be discussed in greater detail below, it should be understood that the function of the fold lines of the blank 700 can be substantially similar to the function of the fold lines of the blank 100, with differences being noted below.

The blank 700 is adapted to be folded into a container configuration, unfolded into an unfolded configuration, and then folded into a stable, collapsed configuration. Before addressing additional fold lines and cut-outs that facilitate unfolding the blank 700 and then folding it into the collapsed configuration, the fold lines that facilitate initial folding of the blank 700 into the container configuration are described.

As shown in FIG. 14, the blank 700 can define an unfolded length $L_U$ and a width $W_U$. The blank 700 includes a lower panel 702 and an upper panel 704 hingedly connected relative to each other. In particular, the upper panel 704 includes a hinge portion 706 which extends laterally across the blank 700 and is positioned between the lower panel 702 and the upper panel 704. For example, the hinge portion 706 can hingedly connect to the lower panel 702 at a first lateral hinge fold line 708 and can hingedly connect to the upper panel 704 at a second lateral hinge fold line 710, thereby hingedly connecting the lower panel 702 to the upper panel 704.

The lower panel 702 can include a front end portion 712 hingedly connected to the lower panel 702 at a front lateral hinge fold line 714. The front end portion 712 can include a first front side portion 716 hingedly connected to a second front side portion 718. As illustrated in FIG. 14, the first and second front side portions 716, 718 can be hingedly connected at double lateral hinge fold lines 720, 722. The double lateral hinge fold lines 720, 722 can be positioned substantially near each other to permit the first front side portion 716 to fold along the double lateral hinge fold lines 720, 722 and be positioned adjacent to the second front side portion 718. In some embodiments, rather than two double lateral hinge fold lines 720, 722, the first and second front side portions 716, 718 can be hingedly connected by a single lateral hinge fold line, e.g., only lateral hinge fold line 720.

The lower panel 702 can include a first lateral side portion 724 and a second lateral side portion 726. The first lateral side portion 724 can extend between first middle flap 728 of the hinge portion 706 and the lateral hinge fold line 714 of the front end portion 712, and can be hingedly connected to the blank 700 at a first part of a first side hinge fold line 730*a*. The second lateral side portion 726 can extend between the second middle flap 732 of the hinge portion 706 and the front lateral hinge fold line 714 of the front end portion 712, and can be hingedly connected to the blank 700 at a first part of a second side hinge fold line 734*a*.

As shown in FIG. 14, the first lateral side portion 724 can include a first flap 736 disposed at a first corner 738 of the front end portion 712. In particular, for purposes of folding the blank 700 into the container configuration, the first flap 736 can be hingedly connected to the first lateral side portion 724 at the front lateral hinge fold line 714 and can be connected to the front end portion 712 along a first front fold line 740 which can be substantially in-line and parallel to the first part of the first side hinge fold line 730*a*. The first front lengthwise fold line 740 can be formed in the blank 700 such that the first flap 736 can be torn or separated from the front end portion 712 along the first lengthwise fold line 740 up to the front lateral hinge fold line 714. In some embodiments, the first front lengthwise fold line 740 can be formed as a perforated line or can include only a few points of attachment relative to the front end portion 712. The first flap 736 can thereby be movably connected to the first lateral side portion 724.

Similarly, the second lateral side portion 726 can include a second flap 742 disposed at a second corner 744 of the front end portion 712. In particular, for purposes of folding the blank 700 into the container configuration, the second flap 742 can be hingedly connected to the second lateral side portion 726 at the front lateral hinge fold line 714 and can be connected to the front end portion 712 along a second front fold line 746 which can be substantially in-line and parallel to the first part of the second side hinge fold line 734*a*. The second front lengthwise fold line 746 can be formed in the blank 700 such that the second flap 742 can be torn or separated from the front end portion 712 along the second front lengthwise fold line 746 up to the front lateral hinge fold line 714. In some embodiments, the second front lengthwise fold line 746 can be formed as a perforated line or can include only a few points of attachment relative to the front end portion 712. The second flap 742 can thereby be movably connected to the second lateral side portion 726.

The upper panel 704 can include a third lateral side portion 748 and a fourth lateral side portion 750. The third lateral side portion 748 can extend in-line with and parallel to the first lateral side portion 724 and can extend between the first middle flap 728 of the hinge portion 706 and the third corner 752 of the blank 700. The third lateral side portion 748 can be hingedly connected to the blank 700 at the second part of the first side hinge fold line 730*b*. The fourth lateral side portion 750 can extend in-line with and parallel to the second lateral side portion 726 and can extend between the second middle flap 732 and the fourth corner 754 of the blank 700. The fourth lateral side portion 750 can be hingedly connected to the blank 700 at the second part of the second side hinge fold line 734*b*. The upper panel 704 can further include a back end portion 756 hingedly connected to the blank 700 at a third lateral hinge fold line 758. In particular, the second side hinge fold line 758 can extend between and perpendicular to the second part of the first side and second side hinge fold lines 730*b*, 734*b*.

The top surface of the blank 700 shown in FIG. 14 can be referred to as the inner surface of the blank 700 and the surface facing away from the viewer in FIG. 14 can be referred to as the outer surface of the blank 700. As noted previously, such a convention may be reversed. The area of the lower panel 702 bounded by the first part of the first and second side hinge fold lines 730*a*, 734*a* and the first and front lateral hinge fold lines 708, 714 define the base portion 760, e.g., the food-supporting surface, when the blank 700 is folded into the container configuration. Similarly, the area of the upper panel 704 bounded by the second part of the first and second side hinge fold lines 730*b*, 734*b* and the second and third lateral hinge fold lines 710, 758 defines a top portion 762, e.g., the lid portion, that is positioned above the food and opposite the base portion 760 when the blank 700 is folded into the container configuration and closed.

In addition to the fold lines discussed above that enable blank 700 to be folded into a container configuration, blank 700 includes additional fold lines and cutouts that facilitate unfolding the blank 700 from a container configuration to an unfolded configuration, and then refolding the blank 700 into a stable collapsed configuration, in accordance with some embodiments. As illustrated in FIG. 14, the blank 700 can include a lengthwise fold line 764 extending across the entire length $L_U$ of the blank 700. In particular, the lengthwise fold line 764 can extend across the lower panel 702, the hinge portion 706 and the upper panel 704. The lengthwise fold line 764 can be positioned at a central position of the width $W_U$ of the blank 700 such that the lengthwise fold line 764 divides the front end portion 712, the base portion 760, the hinge portion 706, the top portion 762 and the back end portion 756 into substantially equal areas, e.g., two substantially equal halves.

With respect to the lower panel 702, the blank 700 can include a first lateral fold line 766 that extends laterally the entire width $W_U$ of the blank 700 and is perpendicular to the lengthwise fold line 764. In particular, the first lateral fold line 766 divides the lower panel 702 into two substantially equal areas, e.g., two substantially equal halves. However, the first lateral fold line 766 divides the base portion 760 into two unequal areas, e.g., a first part 768 and a second part 770, where the area of the second part 770 is substantially larger than the area of the first part 768. Specifically, the area of the first part 768 is defined by the first part of the first and second side hinge fold lines 730*a*, 734*a*, the front lateral hinge fold line 714 and the first lateral fold line 766. The area of the second part 770 is defined by the intersecting portions of the first part of the first and second side hinge fold lines 730*a*, 734*a*, the first lateral hinge fold line 708 and the first lateral fold line 766. As shown in FIG. 14, the first lateral fold line 766 can be offset from a center of the base portion 760 such that the area of the second part 770 is substantially larger than the area of the first part 768. Thus, the distance from the first lateral hinge fold line 708 to the first lateral fold line 766 can be substantially greater than the distance from the first lateral fold line 766 to the front lateral hinge fold line 714.

With respect to the upper panel 704, the blank 700 can include a second lateral fold line 772 that extends laterally the entire width $W_U$ of the blank 700 and is perpendicular to the lengthwise fold line 764. In particular, the second lateral fold line 772 can divide the top portion 762 into two substantially equal areas, e.g., a first part 774 and a second part 776, where the area of the first part 774 is substantially equal to the area of the second part 776. Specifically, the area of the first part 774 is defined by the second part of the first and second side hinge fold lines 730*b*, 734*b*, the second lateral hinge fold line 710 and the second lateral fold line 772. The area of the second part 776 is defined by the second part of the first and second side hinge fold lines 730*b*, 734*b*, the second lateral fold line 772 and the third lateral hinge fold line 758. As shown in FIG. 14, the second lateral fold line 772 can be positioned at approximately a center of the top portion 762 such that the area of the first part 774 is substantially equal to the area of the second part 776. Thus, the distance from the front lateral hinge fold line 710 to the second lateral fold line 772 can be substantially equal to the distance from the second lateral fold line 772 to the third lateral hinge fold line 758.

In some embodiments, the first and second parts of the first and second hinge fold lines 730*a*, 730*b*, 734*a*, 734*b*, respectively, can be aligned relative to each other and can extend the entire length $L_U$ of the blank 700, except for the first and second middle flap cuts 811, 813, respectively, at the hinge portion 706. In the embodiment shown in FIG. 14, first and second perforated lengthwise fold lines 778, 780 can be formed in the blank 700 as an extension of the first part of the first and second side hinge fold lines 730*a*, 734*a*. For example, with respect to the first part of the first side hinge fold line 730*a*, the first perforated lengthwise fold line 778 can be formed along the first part of the first side hinge fold line 730*a* starting from the front lateral hinge fold line 714 and extending a partial distance, e.g., halfway, and the like, in the direction of the first lateral fold line 766. With respect to the first part of the second side hinge fold line 734*a*, the second perforated lengthwise fold line 780 can be formed along the first part of the second side hinge fold line 734*a* starting from the front lateral hinge fold line 714 and extending a partial distance, e.g., halfway, and the like, in the direction of the first lateral fold line 766. In some embodiments, the first and second perforated lengthwise fold lines 778, 780 can extend less than or greater than halfway between the front lateral hinge fold line 714 and the first lateral fold line 766. In some embodiments, the first and second perforated lengthwise fold lines 778, 780 can be formed in the blank 700 with a more frequent pattern of perforations, e.g., approximately every 1/16 inches to 1/8 inches, to allow less resistance when tearing the blank 700 along the perforated lengthwise fold lines 778, 780.

In the embodiment shown in FIG. 14, first and second diagonal fold lines 782, 784 can further be formed in the first and second lateral side portions 724, 726, respectively, of the blank 700. The first and second diagonal fold lines 782, 784 can be diagonal relative to the lengthwise fold line 764, the first and second lateral fold lines 766, 772. For example, the first diagonal fold line 782 can extend diagonally from an endpoint 786 of the first perforated lengthwise fold line 778 away from the first lateral fold line 766 and the first part of the first side hinge fold line 730*a* to an outer edge of the first lateral side portion 724.

Similarly, the second diagonal fold line 784 can extend diagonally from an endpoint 788 of the second perforated lengthwise fold line 780 away from the first part of the second side hinge fold line 734*a* and the first lateral fold line 766 to an outer edge of the second lateral side portion 726.

Still with reference to FIG. 14, the blank 700 is shown with a first embodiment of an interlocking mechanism for maintaining the blank 700 in the collapsed configuration. As discussed above with respect to the blank 100, the interlocking mechanism can function by interaction between the first and second flaps 736, 742. For example, the second flap 742 can include a slot 790 formed therethrough to permit engagement with the first flap 736. In some embodiments, the slot 790 can be a rounded rectangular slot cut out of the blank 700. The slot 790 can be oriented diagonally relative to the lateral and lengthwise fold lines of the blank 700.

The first flap 736 can include a punch-out cut offset from the first corner 738 of the front end portion 712, e.g., one punch-out cut at an outer edge of the first flap 736, to form one or more notches 792 in the first flap 736. Optionally, the first flap 736 can include additional punch-out cuts at the first corner 738 of the front end portion 712 to create chamfered or rounded edges in the first flap 736. The slot 790 of the second flap 742 can be configured and dimensioned to receive the first flap 736 at least partially therethrough up to the notch 792. As will be described in greater detail below, in the collapsed configuration, the first flap 736 can be passed through the slot 790 such that the notch 792 engages the slot 790 and prevents the first flap 736 from disengaging from the second flap 742, thereby functioning as a lock or clip for the "belt loop" interlocking mechanism. The interlocking engagement between the first and second flaps 736, 742 can maintain the blank 700 in a stable collapsed configuration for disposal. Although illustrated with a "belt loop" interlocking mechanism, it should be understood that the blank 700 can include the interlocking mechanism of FIG. 11 or FIG. 12.

In folding the blank 700 of FIG. 14 into the container configuration, the first flap 736 can be separated from the front end portion 712 along the first front fold line 740. For example, the blank 700 can be torn along the first front fold line 740 from the outer edge of the front end portion 712 to the front lateral hinge fold line 714 such that the first flap 736 can remain hingedly connected to the first lateral side portion 724 at the front lateral hinge fold line 714. Similarly, the second flap 742 can be separated from the front end portion 712 along the second front fold line 746. For example, the blank 700 can be torn along the second front fold line 746 from the outer edge of the front end portion 712 to the front lateral hinge fold line 714 such that the second flap 742 can remain hingedly connected to the second lateral side portion 726 at the front lateral hinge fold line 714. In some embodiments, rather than a fold line, the first and second front fold lines 740, 746 can be formed as lengthwise cuts through the blank 700.

Next, the first middle flap 728 can be separated from the third lateral side portion 748 at the first diagonal cut 810 and can be separated from the hinge portion 706 at the first middle flap cut 811. The first middle flap 728 can thereby be separated from the third lateral side portion 748 and the hinge portion 706, while remaining hingedly attached to the first lateral side portion 724 at the third lateral fold line 794. In some embodiments, the third lateral fold line 794 can extend from the outer edge of the first lateral side portion 724 to the first part of the first side hinge fold line 730*a*, and can be substantially linear. In some embodiments, the third lateral fold line 794 can be in-line with and parallel to the first lateral hinge fold line 708. In some embodiments, the third lateral fold line 794 can be formed as an extension of the first lateral hinge fold line 708. The first diagonal cut 810 can extend from an intersection of the second lateral hinge fold line 710 and the second part of the first side hinge fold line 730*b* to an outer edge of the third lateral side portion 748, and can be angled approximately 45 degrees in a direction away from the third lateral fold line 794. The first middle flap cut 811 can be substantially aligned with the first and second part of the first side hinge fold lines 730*a*, 730*b*.

The first lateral side portion 724 can be folded inwardly along the first part of the first side hinge fold line 730*a* until the first lateral side portion 724, the first flap 736 and the first middle flap 728 are positioned at approximately 90 degrees relative to the base portion 760. The first middle flap 728 can be folded inwardly along the third lateral fold line 794 in the direction of the hinge portion 706 such that the first middle flap 728 is positioned at approximately 90 degrees relative to the hinge portion 706 and is aligned with the first lateral hinge fold line 708.

The second middle flap 732 can be similarly separated from the fourth lateral side portion 750 at the second diagonal cut 812 and can be separated from the hinge portion 706 at the second middle flap cut 813. The second middle flap 732 can thereby be separated from the fourth lateral side portion 750 and the hinge portion 706, while remaining hingedly attached to the second lateral side portion 726 at the fourth lateral fold line 796. In some embodiments, the fourth lateral fold line 796 can extend from the outer edge of the second lateral side portion 726 to the first part of the second side hinge fold line 734*a*. In some embodiments, the fourth lateral fold line 796 can be in-line with and parallel to the first lateral hinge fold line 708. In some embodiments, the fourth lateral fold line 796 can be formed as an extension of the first lateral hinge fold line 708. The second diagonal cut 812 can extend from an intersection of the second lateral hinge fold line 710 and the second part of the second side hinge fold line 734*b* to an outer edge of the fourth lateral side portion 750, and can be angled approximately 45 degrees in a direction away from the fourth lateral fold line 796. The second middle flap cut 813 can be substantially aligned with the first and second part of the second side hinge fold lines 734*a*, 734*b*.

The second lateral side portion 726 can be folded inwardly along the first part of the second side hinge fold line 734*a* until the second lateral side portion 726, the second flap 742 and the second middle flap 732 are positioned at approximately 90 degrees relative to the base portion 760. The second middle flap 732 can be folded inwardly along the fourth lateral fold line 796 in the direction of the hinge portion 706 such that the second middle flap 732 is positioned at approximately 90 degrees relative to the hinge portion 706 and is aligned with the first lateral hinge fold line 708.

The first and second flaps 736, 742 can be rotated inwardly approximately 90 degrees along the front lateral hinge fold line 714 to align with the front lateral hinge fold line 714 and face each other. The first and second front side portions 716, 718 of the front end portion 712 can be folded inwardly approximately 90 degrees along the front lateral hinge fold line 714 to be positioned adjacent to the first and second flaps 736, 742. The first front side portion 716 can be further folded approximately 180 degrees such that the first and second front side portions 716, 718 surround and secure the first and second flaps 736, 742 therebetween. The first and second lateral side portions 724, 726 define the side walls, the front end portion 712 defines the front side wall, and the base portion 760 defines the food-supporting surface of the blank 700 when the blank 700 is folded into a container configuration.

As shown in FIG. 14, in some embodiments, the blank 700 can include first and second partial cuts 798, 800, e.g., rectangular cuts, along the front lateral hinge fold line 714. Thus, when the second front side portion 718 is rotated along the front lateral hinge fold line 714, the first and second partial cuts 798, 800 can create two openings along the front lateral hinge fold line 414. The front outer edge of the first front side portion 716 can include first and second protrusions 802, 804 extending therefrom and aligned with the first and second partial cuts 798, 800 in the blank 700. The first and second protrusions 802, 804 can be formed in a complementary manner relative to the first and second partial cuts 798, 800, such that when the first and second front side portions 716, 718 are folded around the first and second flaps 736, 742, the first and second protrusions 802, 804 can interlock relative to the openings formed from the first and second partial cuts 798, 800, respectively, to maintain the first and second flaps 736, 742 in the folded configuration.

The front outer edge of the first front side portion 716 can include at least one cut-out 808, e.g., a half-moon cut-out, a rectangular cut-out, a square cut-out, a circular cut-out, and the like. The cut-out 808 can be adapted to assist in unfolding the blank 700 from the container configuration to the unfolded configuration. For example, the cut-out 808 can provide a grasping means for a user to release the engagement between the first and second protrusions 802, 804 and the openings formed from the partial cuts 798, 800, respectively. Thus, the cut-out 808 can be used to slightly lift the first front side portion 716 to retract the first and second protrusions 802, 804 from the respective openings.

The third lateral side portion 748 can be folded inwardly along the second part of the first side hinge fold line 730*b* in the direction of the top portion 762 such that the third lateral side portion 748 is positioned at approximately 90 degrees relative to the top portion 762. The back end portion 756 can be folded inwardly along the third lateral hinge fold line 758 in the direction of the top portion 748 such that the back end portion 756 is positioned at approximately 90 degrees relative to the top portion 762. In some embodiments, the back end portion 756 can include a partial cut 814 formed along the lateral hinge fold line 758 such that when the back end portion 756 is folded inwardly along the lateral hinge fold line 758, an opening is formed along the third lateral hinge fold line 758. The fourth lateral side portion 750 can be folded inwardly along the second part of the second side hinge fold line 734*b* in the direction of the top portion 762 such that the fourth lateral side portion 750 is positioned at approximately 90 degrees relative to the top portion 762.

The hinge portion 706 can then be rotated in the direction of the base portion 760 along the lateral hinge fold line 708 such that the first and second middle flaps 728, 732 are positioned adjacent to the inner surface of the hinge portion 706 and the base portion 760. The hinge portion 706 defines the back side wall of the blank 700 when the blank 700 is folded into the container configuration. In particular, the hinge portion 706 and the folded front end portion 712 face each other and are substantially parallel relative to each other in the container configuration. Similarly, the first and second lateral side portions 724, 726 face each other and are substantially parallel relative to each other in the container configuration.

The top portion 762 can then be rotated in the direction of the base portion 760 along the front lateral hinge fold line 710 such that the third and fourth lateral side portions 748, 750 and the back end portion 756 are positioned adjacent to and within the side walls formed by the front end portion 712 and the first and second lateral side portions 724, 726. In some embodiments, the second lateral hinge fold line 710 can include first and second partial cuts 816, 818, e.g., rectangular cuts, along the second lateral hinge fold line 710. Thus, when the top portion 762 is rotated along the second lateral hinge fold line 710, the first and second partial cuts 816, 818 create two openings in the hinge portion 706 along the second lateral hinge fold line 710. The top portion 762 defines the lid or cover of the blank 700 when the blank 700 is folded into the container configuration.

After the food stored in the container configuration of the blank 700 has been consumed or moved to a different location, the blank 700 can be unfolded completely into an unfolded configuration, e.g., a substantially flat configuration, in preparation for re-folding the blank 700 into the collapsed configuration for disposal. Those of ordinary skill in the rat should understand that unfolding the blank 700 from the container configuration into the unfolded configuration requires a reversal of the steps described above for folding the blank 700 into the container configuration. As explained above, the cut-out 808 provides a grasping means for a user to release the engagement between the first and second protrusions 802, 804 and the openings formed from the partial cuts 798, 800, respectively. The cut-out 808 can be used to slightly lift the first front side portion 716 to retract the first and second protrusions 802, 804 from the respective openings thereby facilitating the unfolding of the blank 700 from the container configuration to the unfolded configuration. Thus, the orientation and configuration of the blank 700 can be substantially returned to the initial orientation and configuration of the blank 700 shown in FIG. 14.

From the unfolded configuration, the blank 700 can be re-folded into the collapsed configuration by following the procedures described above with respect to the blank 100. For example, the blank 700 can be folded along the first and second lateral fold lines 766, 772, and the first lateral hinge fold line 708 into an accordion-shaped configuration, e.g., two "mountain" folds at the first and second lateral fold lines 766, 772 and a "valley" fold at the first lateral hinge fold line 708. The accordion-shaped blank 700 can be flattened into the partially-collapsed configuration.

The partially-collapsed blank 700 can further be folded along the lengthwise fold line 764, into the fully collapsed configuration. In particular, the blank 700 can be folded along the lengthwise fold line 764 such that the inner surfaces of the two halves of the second part 776 of the top portion 762 are positioned adjacent to each other and the inner surfaces of the two halves of the first part 768 of the base portion 760 face away from each other. Folding the blank 700 along the lengthwise fold line 764 in this manner allows access to the first and second flaps 736, 742.

With respect to the first flap 736, the blank 700 can be separated or torn along the first perforated lengthwise fold line 778 up to the endpoint 786 to extend the length of the first flap 736, while maintaining the first flap 736 hingedly connected to the first lateral side portion 724 along the first diagonal fold line 782. Similarly, with respect to the second flap 742, the blank 700 can be separated or torn along the second perforated lengthwise fold line 780 up to the endpoint 788 to extend the length of the second flap 742, while maintaining the second flap 742 hingedly connected to the second lateral side portion 726 along the second diagonal fold line 784.

Once the blank 700 has been re-folded into the fully collapsed configuration, the first and second flaps 736, 742 can be extended from the collapsed blank 700 by rotating or bending the first and second flaps 736, 742 at the first and second diagonal fold lines 782, 784. The first flap 736 can then be partially passed through the slot 790 of the second flap 742 and the notch 792 of the first flap 736 can be engaged with the sides of the slot 790 to prevent separation of the first flap 736 relative to the second flap 742. In some embodiments, once the first and second flaps 736, 742 have been interlocked, the force on the first and second flaps 736, 742 due to the stress in the folds of the blank 700 in the fully collapsed configuration can maintain the notch 792 engaged with the slot 790 to prevent the first flap 736 from disengaging the second flap 742. Thus, the interlocking mechanism maintains the blank 700 in the stable fully collapsed configuration. The efficiently collapsed blank 700 can thereby be disposed of in various locations due to the reduced size.

In particular, by re-folding the blank 700 into the collapsed configuration, the blank 700 can be compactly and conveniently collapsed for disposal. In some embodiments, similar to FIG. 9, the collapsed length of the blank 700 in the collapsed configuration can be between approximately 40 percent and approximately 60 percent of the length of the blank 700 in the container configuration. In some embodiments, the collapsed length of the blank 700 in the collapsed configuration can be between approximately 45 percent and approximately 55 percent of the length of the blank 700 in the container configuration. In some embodiments, the collapsed length of the blank 700 in the collapsed configuration can be approximately 50 percent of the length of the blank 700 in the container configuration.

Similarly, the collapsed width of the blank 700 in the collapsed configuration can be between approximately 40 percent and approximately 60 percent of the width of the blank 700 in the container configuration. In some embodiments, the collapsed width of the blank 700 in the collapsed configuration can be between approximately 45 percent and approximately 55 percent of the width of the blank 700 in the container configuration. In some embodiments, the collapsed width of the blank 700 in the collapsed configuration can be approximately 50 percent of the width of the blank 700 in the container configuration.

Figure 15:
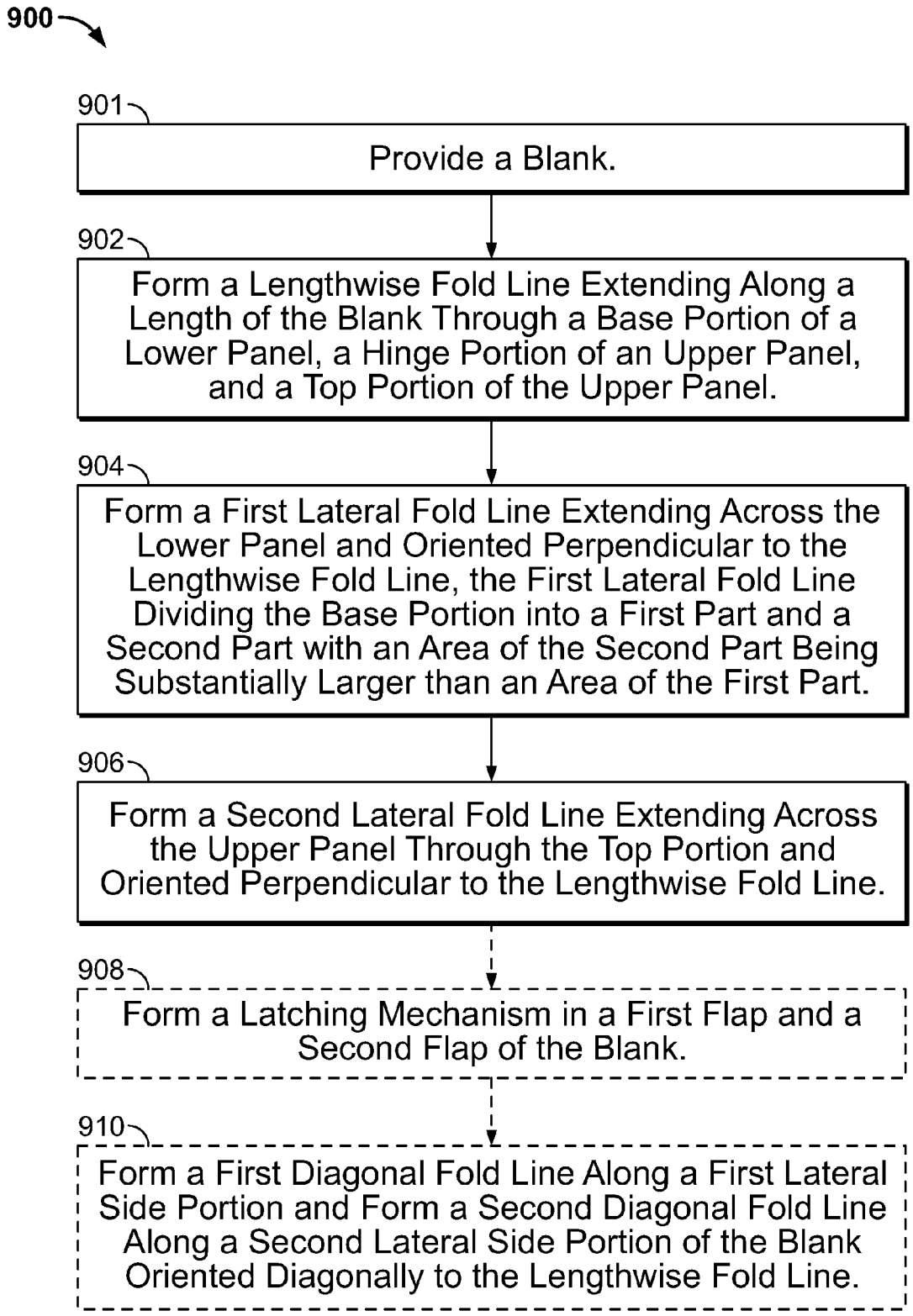
FIG. 15 is a block diagram of a method of forming a blank for a collapsible folded container for food, in accordance with another embodiment of the present disclosure.

A method of forming a blank for a collapsible, folded container for food is also described, in accordance with another embodiment. FIG. 15 is a block diagram of a method 900 for forming a blank for a collapsible folded container for food. The method of FIG. 15 describes formation of additional fold lines and, optionally, cut-outs, in a traditional blank to permit the blank to be compactly folded into the collapsed configuration for disposal. Solely for illustrative purposes, method 900 is described with respect to blank 100; however, one of ordinary skill in the art would appreciate that method 900 could be used to form other blanks that fall within the scope of the present disclosure (e.g., blank 300, blank 400, blank 500, blank 700, etc.). The method 900 includes providing a blank 100 including a lower panel 102 including a base portion 160 that forms a food supporting surface when the blank 100 is folded into a container configuration (901). The blank 100 includes an upper panel 104 with a hinge portion 106 hingedly connected with the lower panel 102 at a first lateral hinge fold line 108 and a top portion 162 hingedly connecting with the hinge portion 106 at a second lateral hinge fold line 100.

One of ordinary skill in the art would understand how to form fold lines and cut-outs generally found in traditional blanks, e.g., the first and second lateral hinge fold lines 108, 110, the front lateral hinge fold line 114, the double front hinge fold lines 120, 122, the first and second parts of the first and second side hinge fold lines 130*a*, 130*b*, 134*a*, 134*b*, the first and second front fold lines 140, 146, the third lateral hinge fold line 158, the first and second side lateral hinge fold lines 522, 530, the first and second front lengthwise hinge fold lines 536, 540, the first and second side lengthwise hinge fold lines 546, 552, the first and second front fold lines 740, 746, the first and second diagonal cuts 810, 812, and the like.

With reference to FIG. 15, the method 900 includes forming a lengthwise fold line (e.g., lengthwise fold line 164 of FIG. 1) extending along a length $L_U$ of the blank through the base portion 160 of the lower panel, the hinge portion 106 of the upper panel, and the top portion 162 of the upper panel (902). The method 900 includes forming a first lateral fold line (e.g., first lateral fold line 166 of FIG. 1) extending across the lower panel 102 and oriented perpendicular to the lengthwise fold line 164 (904). As described above, the first lateral fold line 166 divides the base portion into a first part 168 and a second part 170 with an area of the second part being substantially larger than an area of the first part. The method 900 further includes forming a second lateral fold line (e.g., second lateral fold line 172 of FIG. 1) extending across the upper panel 104 through the top portion 162 and oriented perpendicular to the lengthwise fold line 164 (906). Although FIG. 15 graphically depicts forming the lengthwise fold line 164, the first lateral fold line 166, and then the second lateral fold line 168, it should be understood that formation of these fold lines may occur in any order or simultaneously.

Optionally, in some embodiments, the method 900 includes forming a latching mechanism (e.g., slot 190, first and second notches 192*a*, 192*b*, and first and second rounded edges 194*a*, 194*b* of FIG. 1) in a first flap 136 and a second flap 142 of the blank such that the first and second flaps 136, 142 can interlock relative to each other (908). In some embodiments, forming the latching mechanism includes forming a slot (e.g., slot 190 of FIG. 1, slot 602 of FIG. 13, slot 742 of FIG. 14) in the first flap and/or the second flap. In some embodiments, forming the latching mechanism includes forming one or more notches (e.g., notches in the first flap and/or the second flap (e.g., first notch 192*a* and second notch 192*b* in FIG. 1, first notch 204 and second notch 304 in FIG. 11, notch 792 in FIG. 14). In some embodiments, the notch cooperates with the slot to form a locking mechanism (see FIGS. 10, 13, 14). In some embodiments, notches cooperate with each other to form the locking mechanism (see FIG. 11). In some embodiments, forming the latching mechanism includes disposing an adhesive on one or both of the first flap and the second flap (see FIG. 12). Optionally, in some embodiments, the method 900 includes forming a first diagonal fold line (e.g., first diagonal fold line 182 of FIG. 1) along a first lateral side portion 124 and forming a second diagonal fold line (e.g., second diagonal fold line 184 of FIG. 1) along a second lateral side portion 126 of the blank oriented diagonally to the lengthwise fold line 164 (910). The first and second diagonal fold lines 182, 184 can hingedly connect the first and second flaps 136, 142 to the first and second lateral side portions 182, 184, respectively.

As described herein, it should be understood that the exemplary fold lines, e.g., the first and second lateral fold lines, the lengthwise fold line, and the like, can be advantageously added to blanks for food containers to permit the food container to be folded into the container configuration for transport of food, unfolded into the unfolded configuration, and then compactly re-folded into the collapsed configuration for disposal.

In some embodiments, the step of providing the blank (901) at least partially overlaps the steps of forming the lengthwise fold line (902), forming the first lateral fold line (902) and forming the second lateral fold line (906). For example, the cutouts and lines found in a traditional blank may be formed before, during, or after formation of the lengthwise fold line, the first lateral fold line and the second lateral fold line. In such an embodiment, the locations of the lengthwise fold line, the first lateral fold line and the second lateral fold line are defined relative to the locations of the cutouts and lines of the resulting provided blank.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A blank for a collapsible, folded container for food, the blank comprising:

a lower panel including (i) a base portion that forms a food supporting surface when the blank is folded into a container configuration, and (ii) a front end portion including a first corner, a second corner, a first flap disposed at the first corner, and a second flap disposed at the second corner;

an upper panel including a hinge portion hingedly connecting with the lower panel at a first hinge fold line, and a top portion hingedly connecting with the hinge portion at a second hinge fold line;

a lengthwise fold line extending along a length of the blank, at least, through the base portion of the lower panel, the hinge portion of the upper panel, and the top portion of the upper panel;

a first lateral fold line extending across the lower panel and oriented perpendicular to the lengthwise fold line, the first lateral fold line dividing the base portion into a first part and a second part with an area of the second part being substantially larger than an area of the first part; and a second lateral fold line extending across the upper panel through the top portion and oriented perpendicular to the lengthwise fold line;

wherein the blank is adapted to be folded into a container configuration, subsequently unfolded into an unfolded configuration, and then re-folded using the lengthwise fold line, the first lateral fold line, the first hinge fold line, and the second lateral fold line into a collapsed configuration; and wherein the first flap and the second flap of the lower panel are adapted to interlock with each other to secure a configuration of the blank when it is in the collapsed configuration.

2. The blank according to claim 1, wherein the lengthwise fold line divides the base portion into two parts having substantially equal areas.

3. The blank according to claim 2, wherein the lengthwise fold line includes an upper panel portion and a lower panel portion and wherein the second lateral fold line divides the upper panel portion of the lengthwise fold line into two segments having about equal lengths.

4. The blank according to claim 1, wherein the front end portion is hingedly connected to the base portion, the front end portion including at least one cut-out adapted to assist in unfolding the blank from the container configuration to the unfolded configuration.

5. The blank according to claim 4, wherein the at least one cut-out defines a half-moon shape.

6. The blank according to claim 4, wherein the at least one cut-out defines a circular shape.

7. The blank according to claim 1, wherein:

the front end portion further includes a first lateral side portion and a second lateral side portion;

the first flap is hingedly connected to the first lateral side portion; and the second flap is hingedly connected to the second lateral side portion.

8. The blank according to claim 7, wherein the first flap is hingedly connected to the first lateral side portion at a first diagonal fold line, and the second flap is hingedly connected to the second lateral side portion at a second diagonal fold line, the first diagonal fold line and the second diagonal fold line being oriented diagonally to the lengthwise fold line.

9. The blank according to claim 1, wherein the first flap includes a slot, the slot being adapted to at least partially receive the second flap therethrough, and wherein the second flap includes at least one notch, the at least one notch being adapted to interlock with the slot to maintain the blank in the collapsed configuration.

10. The blank according to claim 1, wherein the first flap includes a first notch and the second flap includes a second notch, the first notch being adapted to interlock with the second notch to maintain the blank in the collapsed configuration.

11. The blank according to claim 1, wherein at least one of the first flap and the second flap includes adhesive thereon, the adhesive being adapted to interlock the first flap and the second flap to maintain the blank in the collapsed configuration.

12. The blank according to claim 1, wherein the blank has a container width and a container length while in the container configuration, and has a collapsed width smaller than the container width and a collapsed length smaller than the container length when in a collapsed configuration.

13. The blank according to claim 12, wherein the collapsed length is in a range of 40% to 60% of the container length and wherein the collapsed width is in a range of 40% to 60% of the container width.

14. The blank according to claim 1, further comprising instructions for unfolding the blank from a container configuration and re-folding the blank into the collapsed configuration.

15. A blank for a collapsible container for food, the blank comprising:

a lower panel including:

a base portion that forms a food supporting surface when the blank is folded into a container configuration;

a front end portion including interlocking elements, the interlocking elements including a first flap disposed at a first corner of the front end portion and a second flap disposed at a second corner of the front end portion, the first flap and the second flap being adapted to interlock with each other when the container is in a collapsed configuration;

a first lateral fold line extending through the base portion;

an upper panel including:

a hinge portion hingedly connected with the lower panel at a first hinge fold line, the second part of the lower panel surface being proximal to the hinge portion;

a top portion hingedly connected with the hinge portion; and a second lateral fold line extending through the top portion; and a lengthwise fold line extending through the lower panel and the upper panel;

the blank being adapted to maintain a stable collapsed configuration when collapsed by:

mountain-type folding at the first lateral fold line;

mountain-type folding at the second lateral fold line;

valley-type folding at the first hinge fold line resulting in an accordion-type configuration;

subsequently folding the accordion-type configuration along the lengthwise fold line; and interlocking the interlocking elements.

16. The blank according to claim 15, wherein:

the first flap is hingedly connected to a first lateral portion of the lower panel at a first diagonal fold line; and the second flap is hingedly connected to a second lateral portion of the lower panel at a second diagonal fold line, wherein the first diagonal fold line and the second diagonal fold line are oriented diagonally to the lengthwise fold line.

17. The blank according to claim 16, wherein the first flap includes a slot and the second flap includes at least one notch, the slot being adapted to at least partially receive the second flap therethrough.

18. The blank according to claim 15, wherein the interlocking elements are adapted to releasably interlock relative to each other.

19. A method of forming a blank for a collapsible, folded container for food, the method comprising:

providing a blank including:

a lower panel including a base portion that forms a food supporting surface when the blank is folded into a container configuration; and an upper panel including a hinge portion hingedly connecting with the lower panel at a first hinge fold line and a top portion hingedly connecting with the hinge portion at a second hinge fold line; and forming a lengthwise fold line extending along a length of the blank, at least, through the base portion of the lower panel, the hinge portion of the upper panel, and the top portion of the upper panel;

forming a first lateral fold line extending across the lower panel and oriented perpendicular to the lengthwise fold line, the first lateral fold line dividing the base portion into a first part and a second part with an area of the second part being substantially larger than an area of the first part;

forming a second lateral fold line extending across the upper panel through the top portion and oriented perpendicular to the lengthwise fold line; and forming a latching mechanism including a first flap at a first corner of a front end portion of the lower panel and forming a second flap at a second corner of the front end portion of the lower panel, the first flap and the second flap adapted to interlock with each other when the blank is in a collapsed configuration.

20. The method according to claim 19, further comprising forming a slot in the first flap and forming at least one notch in the second flap, the slot being adapted to at least partially receive the second flap therethrough.

21. The method according to claim 19, further comprising forming a first diagonal fold line along a first lateral side portion, the first diagonal fold line hingedly connecting the first flap to the first lateral side portion and oriented diagonally to the lengthwise fold line, and forming a second diagonal fold line along a second lateral side portion, the second diagonal fold line hingedly connecting the second flap to the second lateral side portion and oriented diagonally to the lengthwise fold line.

* * * * *